US007108391B2

(12) United States Patent
Chuang

(10) Patent No.: US 7,108,391 B2
(45) Date of Patent: Sep. 19, 2006

(54) ARTIFICIAL MINIATURE, LANDSCAPE MODEL WITH THREE DIMENSIONALLY VARIABLE COLORED LEDS

(76) Inventor: Hsien-Tsung Chuang, No. 52-17, Jhongshan Rd., Bail Township, Taipei County (TW)

( * ) Notice: Subject to any disclaimer, the term of this patent is extended or adjusted under 35 U.S.C. 154(b) by 93 days.

(21) Appl. No.: 10/770,500

(22) Filed: Feb. 4, 2004

(65) Prior Publication Data

US 2005/0168973 A1 Aug. 4, 2005

(51) Int. Cl.
*F21S 6/00* (2006.01)

(52) U.S. Cl. ..... 362/122; 362/555; 362/567

(58) Field of Classification Search ..... 362/123, 362/122, 567, 564, 806, 800
See application file for complete search history.

(56) References Cited

U.S. PATENT DOCUMENTS 4,399,493 A * 8/1983 Kurita et al. ..... 362/122
5,063,485 A * 11/1991 Harris ..... 362/122
6,174,072 B1 * 1/2001 Root, Jr. ..... 362/190
6,364,501 B1 * 4/2002 Tai ..... 362/122
6,625,506 B1 * 9/2003 Yeh ..... 700/94
6,918,692 B1 * 7/2005 Yang ..... 362/567
2004/0085758 A1 * 5/2004 Deng ..... 362/122
2004/0228121 A1 * 11/2004 Homg ..... 362/122

* cited by examiner

*Primary Examiner*—Renee Luebke
*Assistant Examiner*—Gunyoung T. Lee

(57) ABSTRACT

An artificial miniature landscape model includes a plurality of multi-colored LEDS, metallic conductor branches, electrically insulated conductors, heat shrink bushings, or insulation tubular plugs, or internally or externally threaded tubular connectors, a low voltage rectifier, base connectors, molded artifacts, and pots. A plurality of variable colored LEDS are affixed to a molded transparent resin structure of an artificial flower, fruit, bird, leaf or butterfly to exhibit a three dimensionally colored lighting effect. Further, connectors are provided for connection of electrical conductors that supply power to illuminate the LEDS and to operate electrical devices that accompany the miniature landscape model.

10 Claims, 44 Drawing Sheets

ARTIFICIAL MINIATURE, LANDSCAPE MODEL WITH THREE DIMENSIONALLY VARIABLE COLORED LEDS

BACKGROUND OF THE INVENTION

1. Field of the Invention

The present invention relates to an artificial miniature landscape model which is ornamented with three dimensionally variable colored LEDS.

2. Description of the Prior Art

The conventional illuminated decorative potted plant displays which can be bought from the markets are usually formed of a fixture containing an incandescent lamp. As it is well known that the incandescent lamp has several inherent disadvantages of a low efficiency, a short lifetime and a low light intensity, it is therefore not suitable for use where ample color variation and light intensity are required.

Besides, instead of the incandescent lamp, LEDS have been installed in the bottom cavity of a rotatable pot to illuminate the potted plant upwardly from the bottom. However, the bottom of the pot often interrupts transmission of the light beam of the LEDS, thereby considerably lowering the lighting effect.

In view of this, a light source has been introduced to the flower with an optical fiber conductor, but as the light source is a spot light affixed to the flower without being matched with the contour of the flower, there is a lack of a three dimensionally vivid and appealing display. For demonstration of an active feeling, the pot is rotated by a driving motor together with a color disc, thereby always causing inevitable noise from the rotating motor and shortening the durability of the light source.

SUMMARY OF THE INVENTION

Aiming at the above depicted defects inherent to the prior techniques, the present invention provides a newly developed construction of an artificial miniature landscape model with three dimensionally variable colored LEDS (also called multi-colored LEDS), wherein variable colored LEDS are affixed within a molded transparent resin structure of artificial flowers, fruits, birds, leaves, and butterflies so as to exhibit a three dimensionally variable colored lighting effect of the LEDS contained in the transparent molded resin structure.

The main structure of the first embodiment comprises an artificial miniature landscape model with three dimensionally colored LEDS and is essentially composed of a plurality of automatic color variable LEDS, metallic conductor submains, heat shrink bushings or heat resisting insulation tube plugs, externally or internally threaded tube connectors, electrically insulated conductors, a low voltage rectifier, flowers, leaf blades, fruits, birds, butterflies, coniferous Christmas trees formed into molded transparent resin structures, and pots.

Wherein, the LEDS are sealed in the molded transparent resin structure at a certain properly inclined angle. The submains of the potted plant are constructed of a plurality of various sized (diameters) copper tubes bent and welded, and are assembled section by section with screws.

The root of a trunk of said potted plant is provided with two flanges and is fixed into the pot with a binder made of mixed resin and ballast material. The electricity is supplied from a low voltage rectifier via a power supply switch to the LEDS.

The above objects and other advantages of the present invention will become more apparent by describing in detail the preferred embodiments of the present invention with reference to the following attached drawings.

DETAILED DESCRIPTION OF THE PREFERRED EMBODIMENT

Several embodiments of the present invention will be described in detail with reference to the attached drawings hereinbelow;

Embodiment 1

Figure 6:
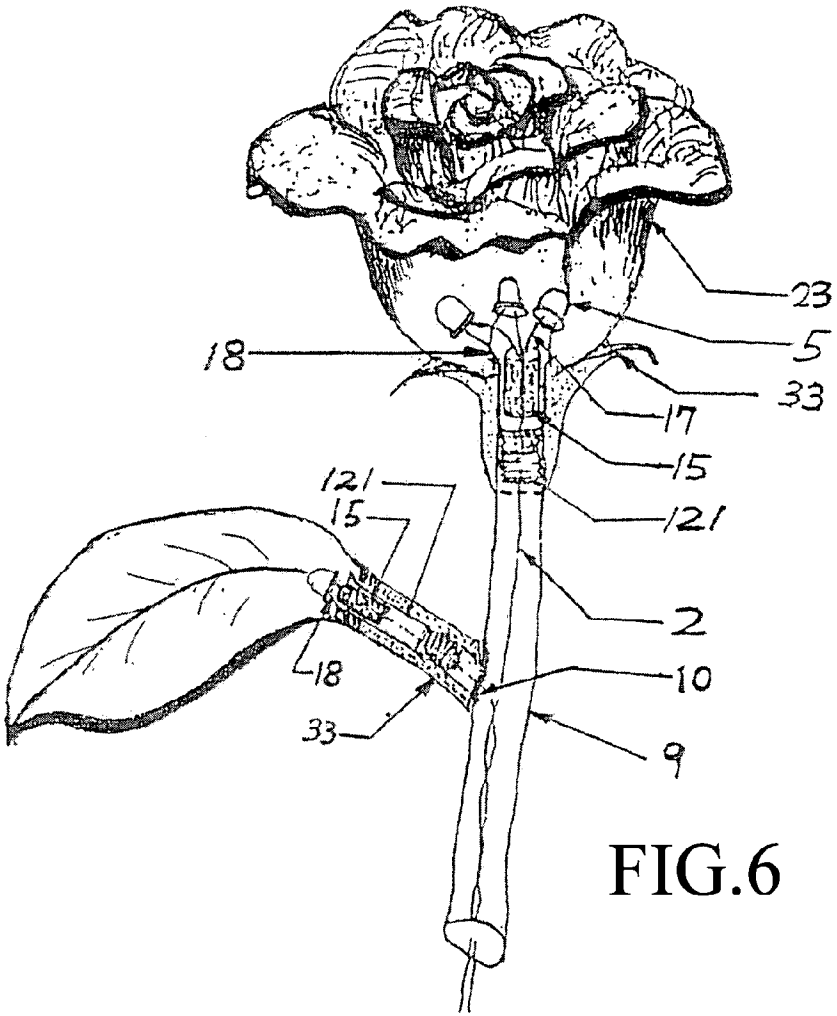
FIG. 6 is a schematic view showing a group of LEDS affixed to a flower and a leaf.
Figure 5:
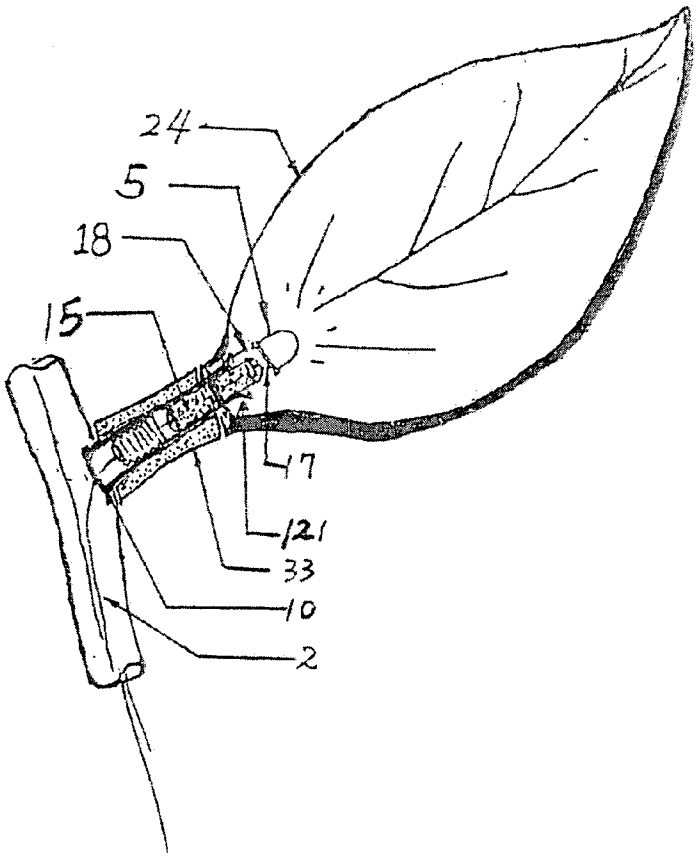
FIG. 5 is a schematic view of an LED affixed to a leaf.
Figure 8:
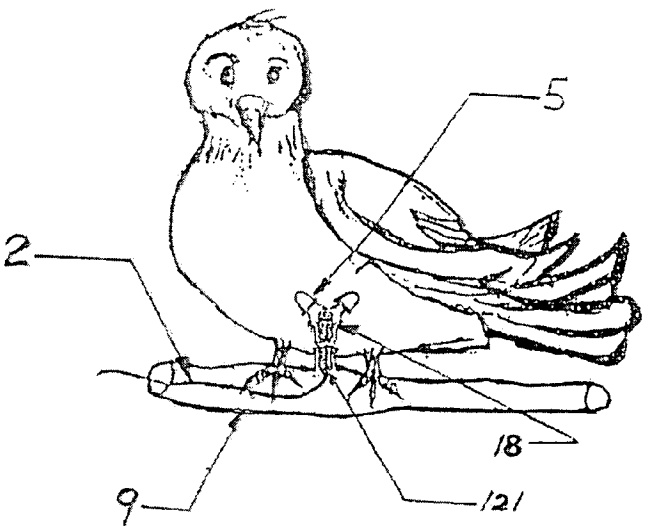
FIG. 8 is a schematic view showing a bird with LEDS perched on a tree branch.
Figure 7:
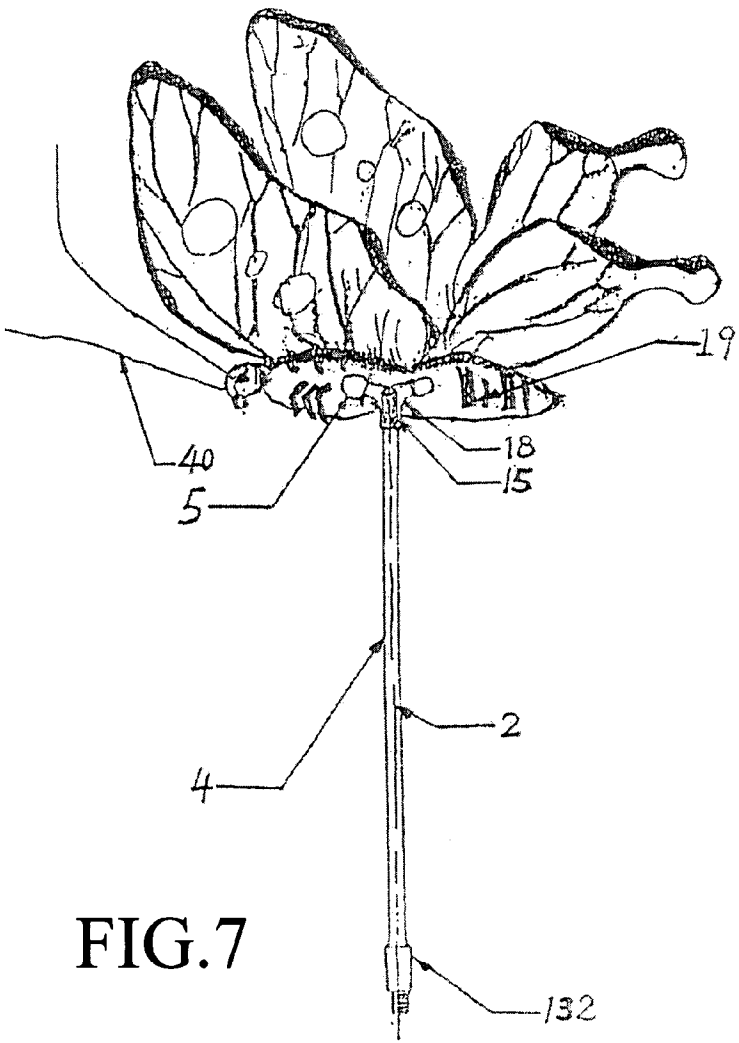
FIG. 7 is a schematic view showing how a butterfly together with LEDS is supported.
Figure 10:
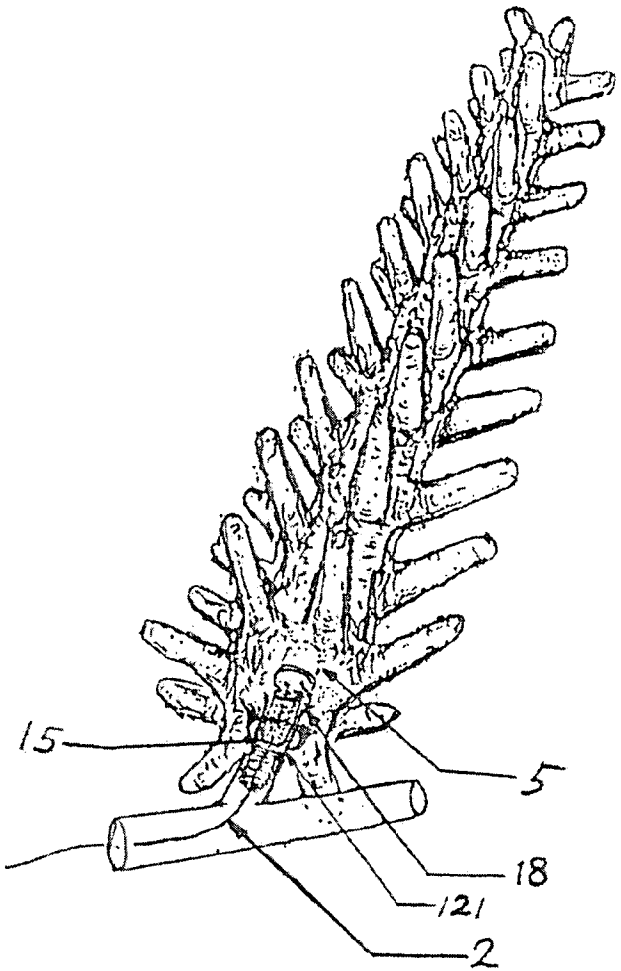
FIG. 10 is a schematic view showing a coniferous leaf of a Christmas tree affixed with an LED.
Figure 9:
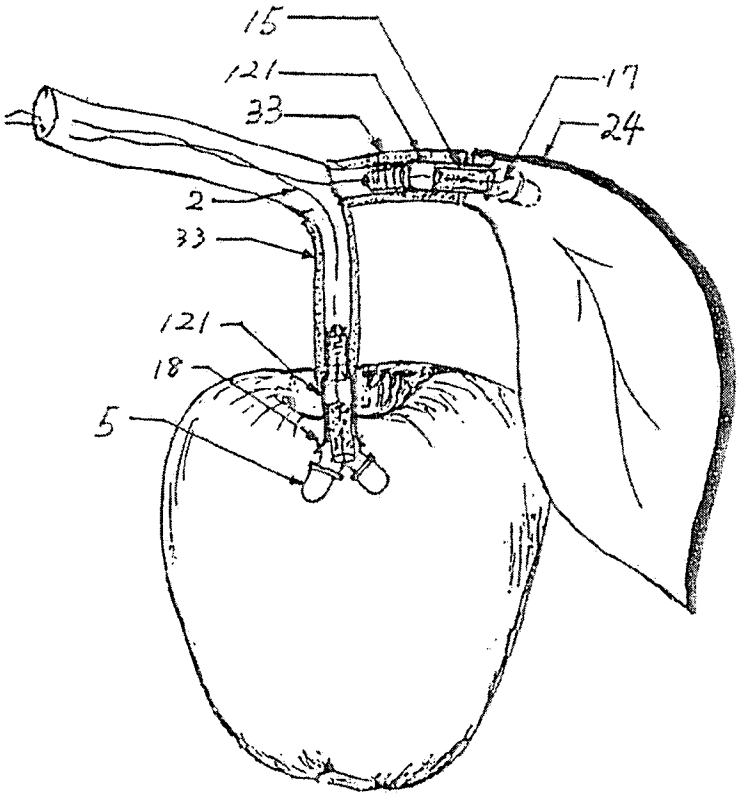
FIG. 9 is a schematic view sowing a fruit affixed with LEDS.
Figure 11:
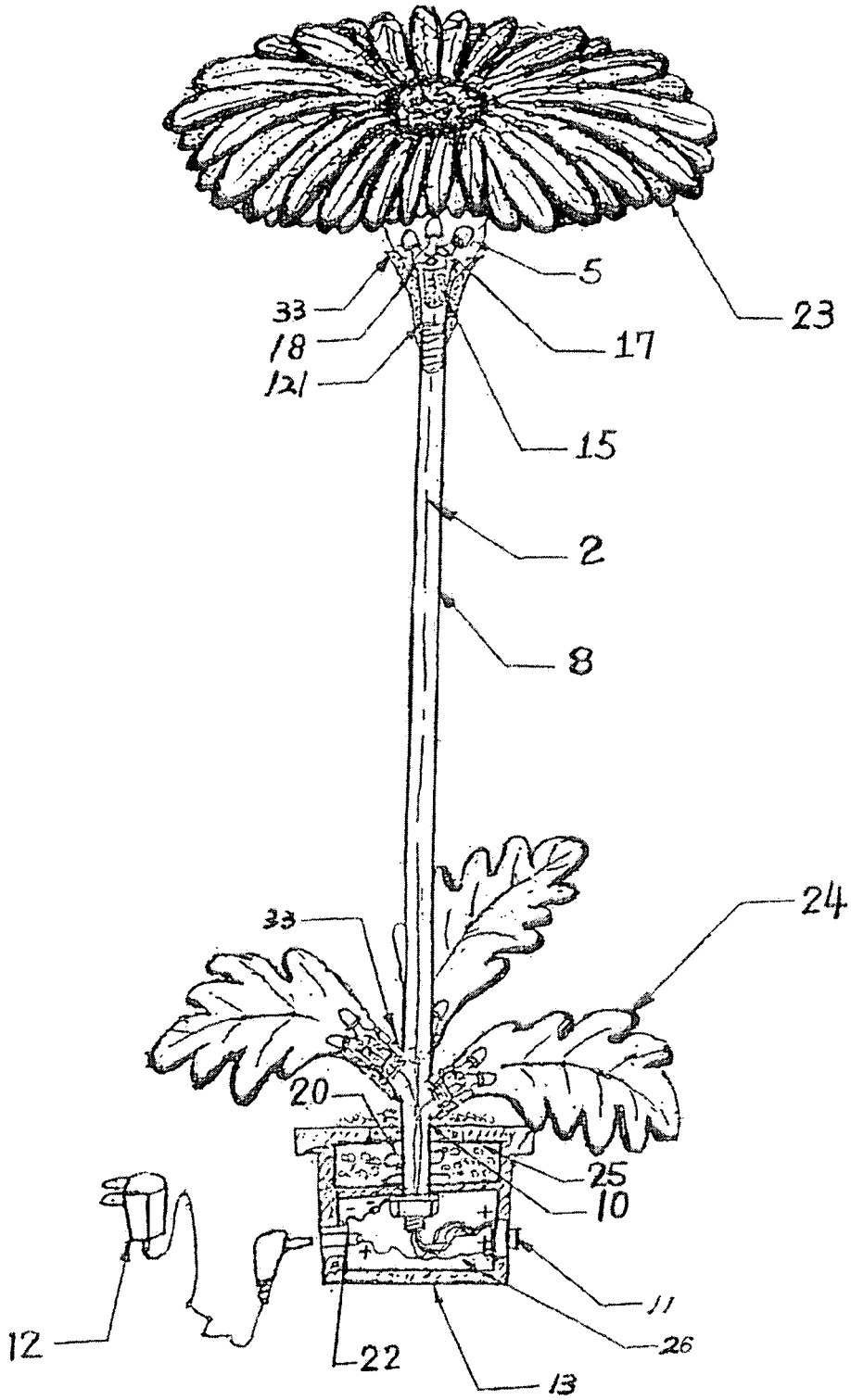
FIG. 11 is a schematic view of a potted African daisy (sunflower) plant with LEDS.
Figure 12:
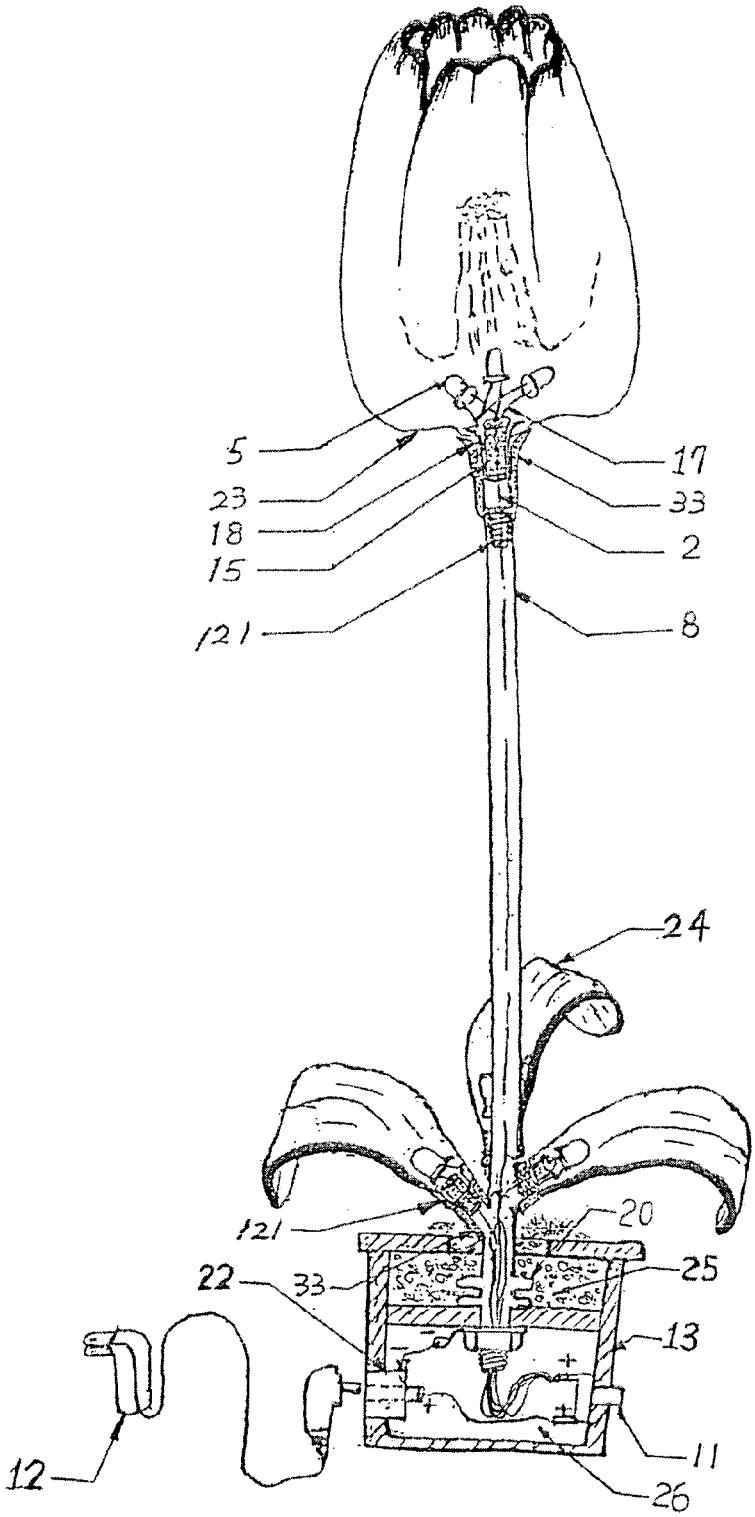
FIG. 12 is a schematic view of a potted tulip plant with LEDS.
Figure 34:
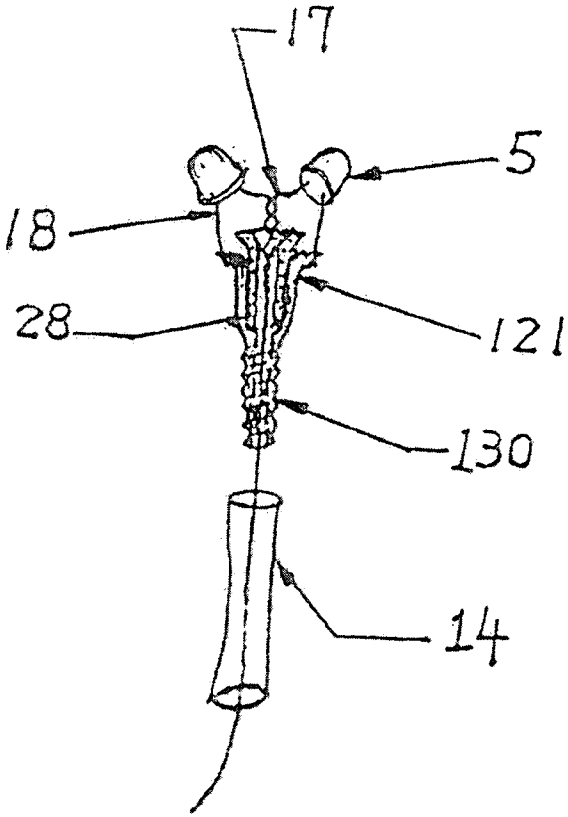
FIG. 34 is a schematic view of an externally threaded copper alloy connector.
Figure 33:
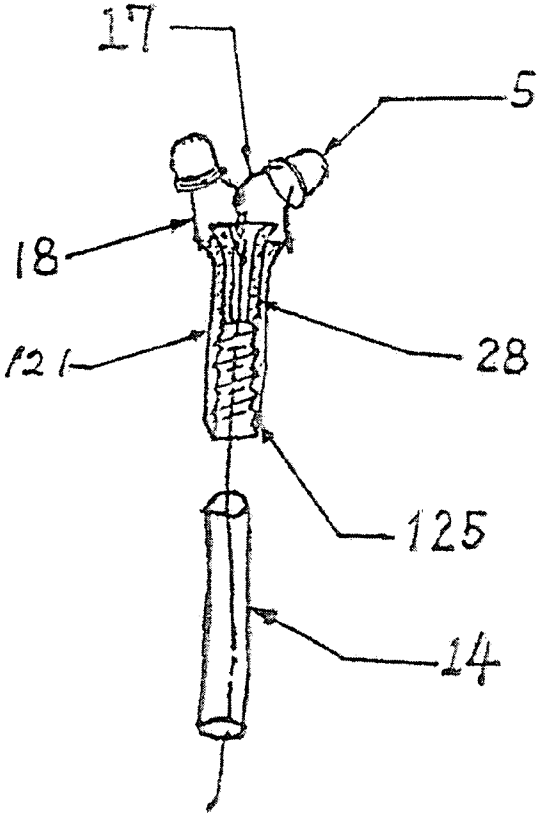
FIG. 33 is a schematic view of an internally threaded copper alloy connector.
Figure 36:
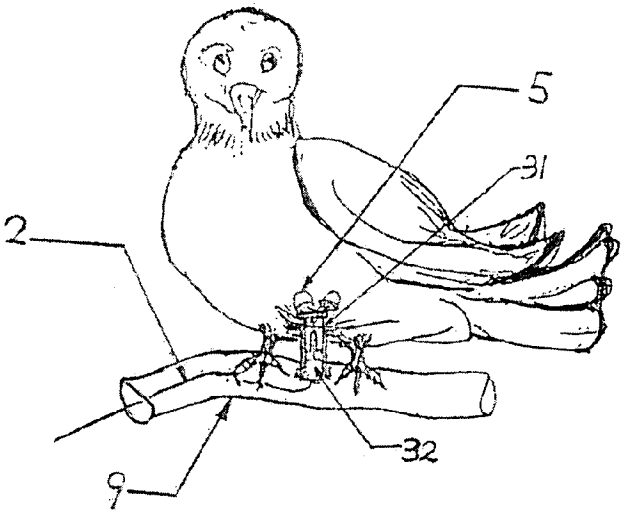
FIG. 36 is a schematic view showing the method of connecting LEDS to an A connector in the body of a bird statue.
Figure 37:
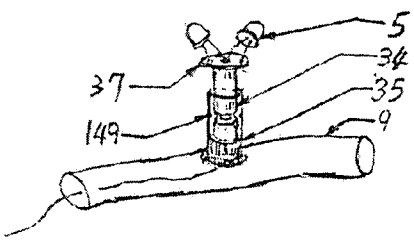
FIG. 37 is a detailed view illustrating how the LEDS are connected to a B connector in the body of a bird statue.
Figure 35:
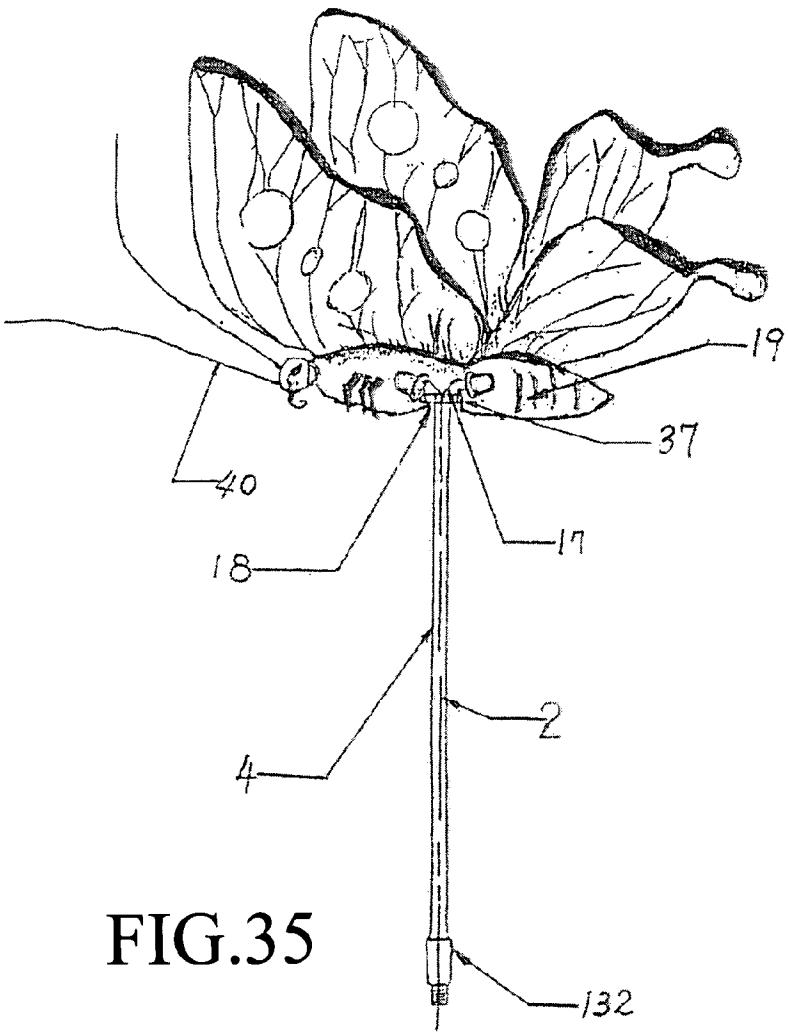
FIG. 35 is a schematic view showing the method of fixing LEDS to a PCB in the body of an artificial butterfly.
Figure 44:
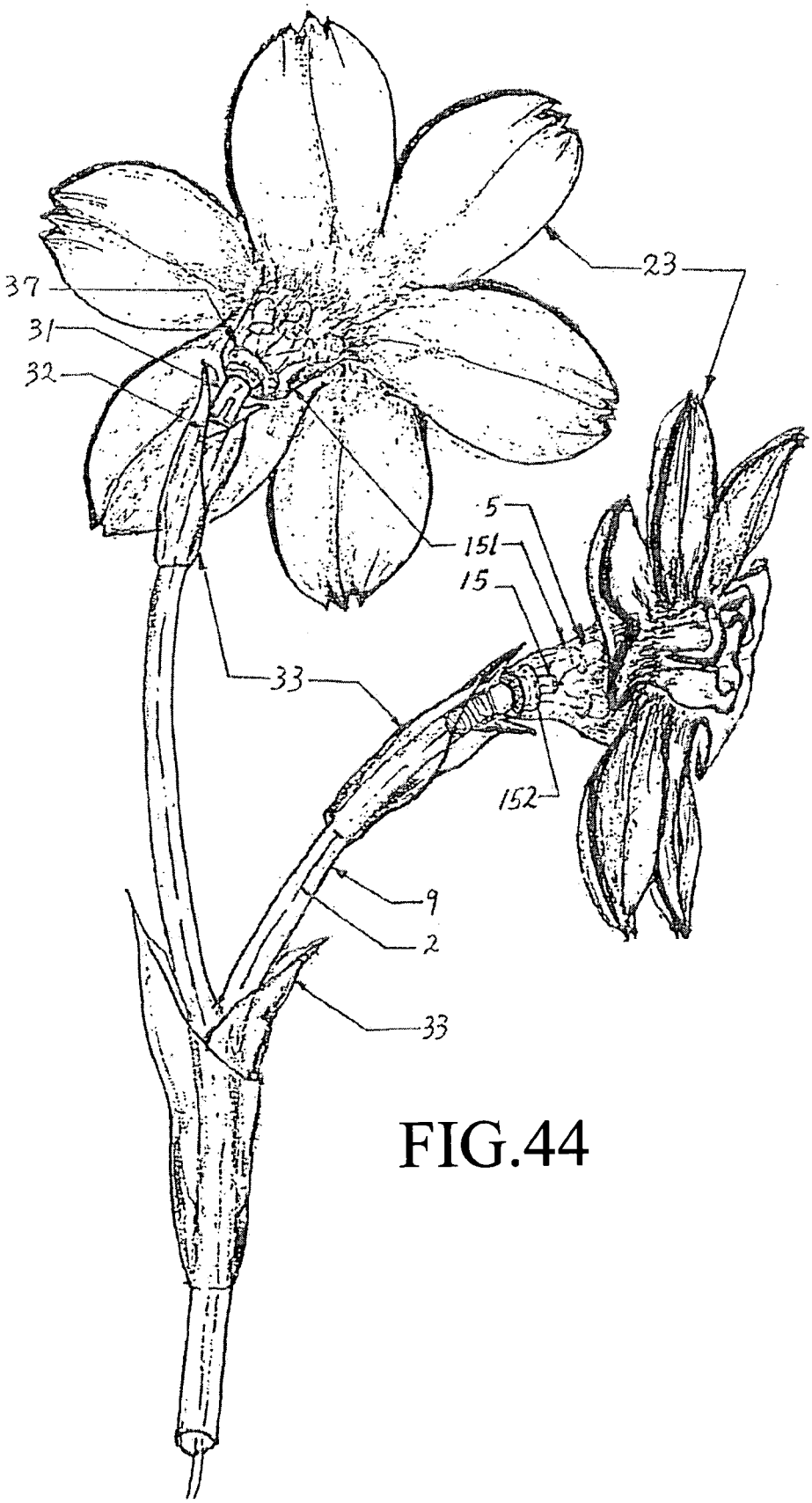
FIG. 44 is a schematic view showing a funnel shaped molded transparent resin structure is formed at the torus of the daffodil for sealing LEDS in there.
Figure 45A:
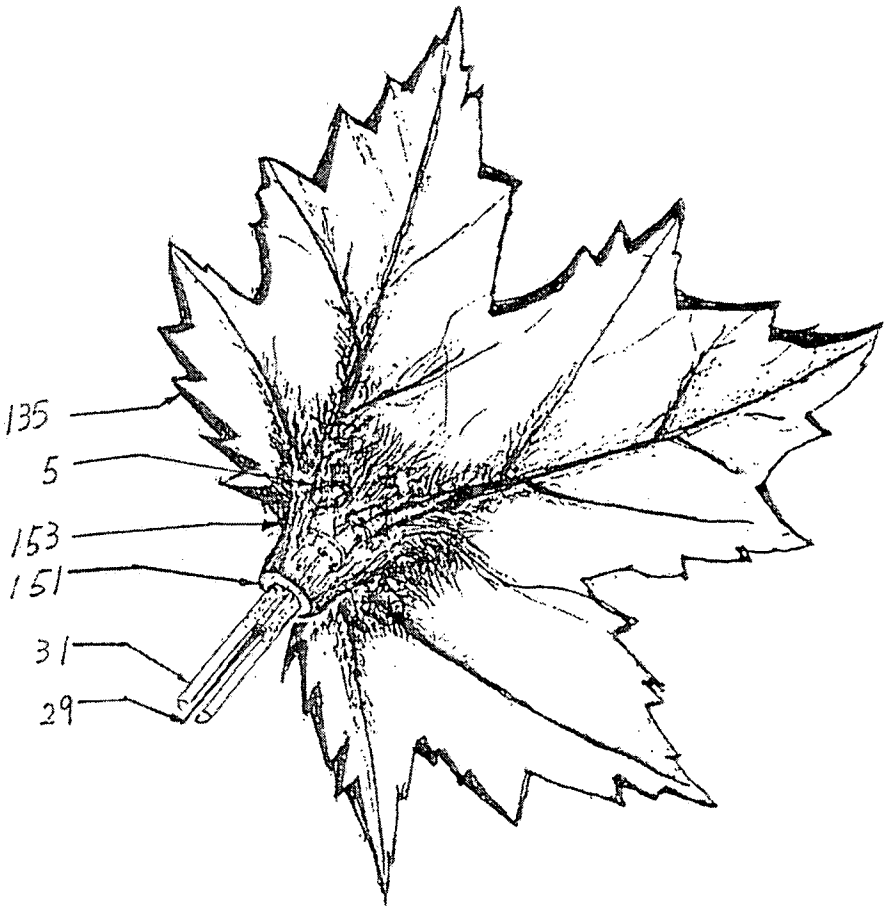
FIG. 45A is a schematic view showing a funnel shaped molded transparent resin structure formed at the bottom of a maple leaf stalk.
Figure 45:
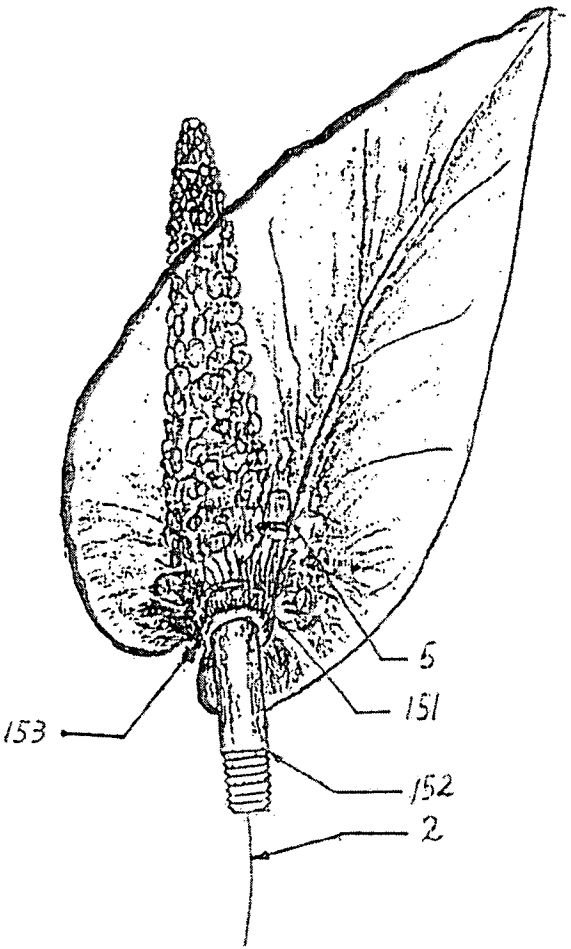
FIG. 45 is schematic view showing a funnel shaped molded transparent resin structure formed at the torus of an *Anthurium scherzerianum* and having an aperture at the bottom of the leaf stalk.
Figure 47:
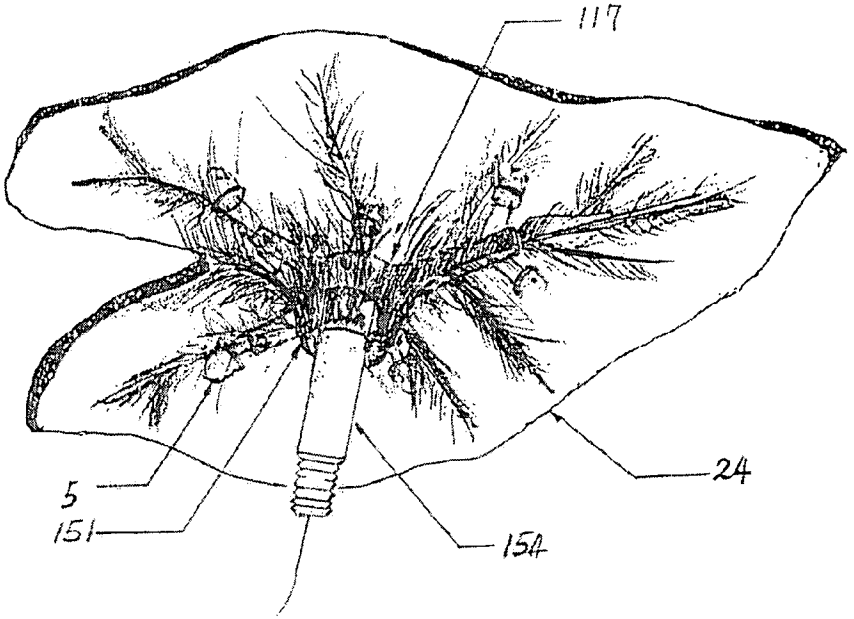
FIG. 47 is a schematic view showing a funnel shaped molded transparent resin structure formed at the leaf stalk of a cala lily.
Figure 46:
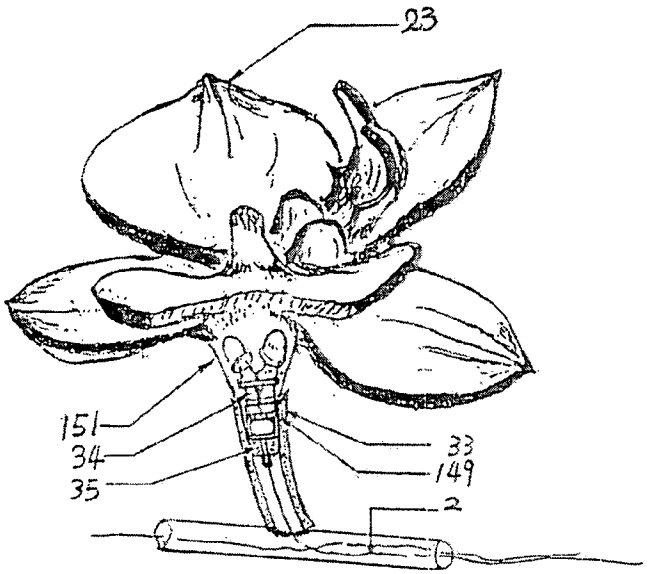
FIG. 46 is a schematic view showing a cone shaped molded transparent resin structure formed at the torus of an orchid.
Figure 48A:
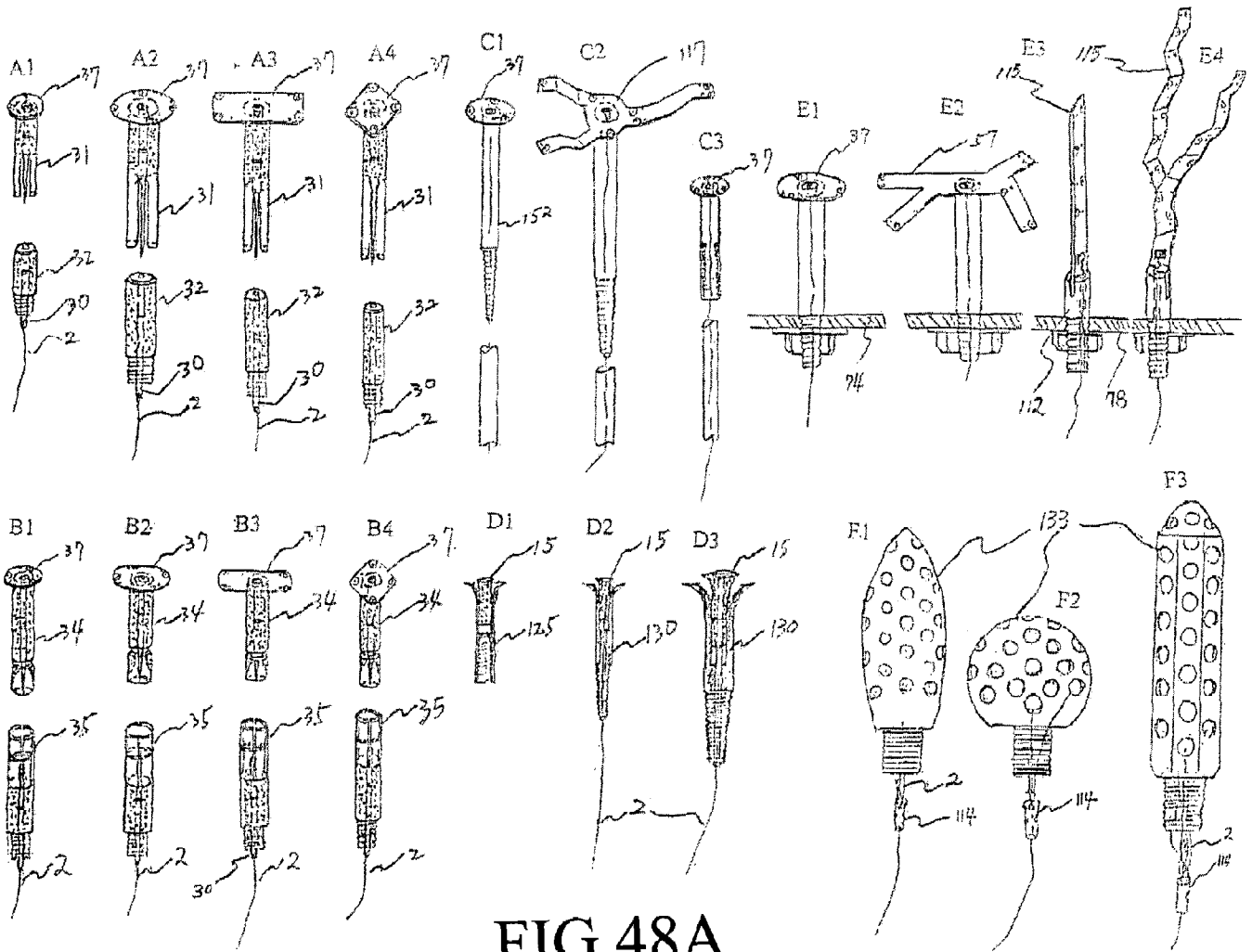
FIG. 48A is a schematic view showing various types of electrical connectors employed by the present invention.
Figure 48B:
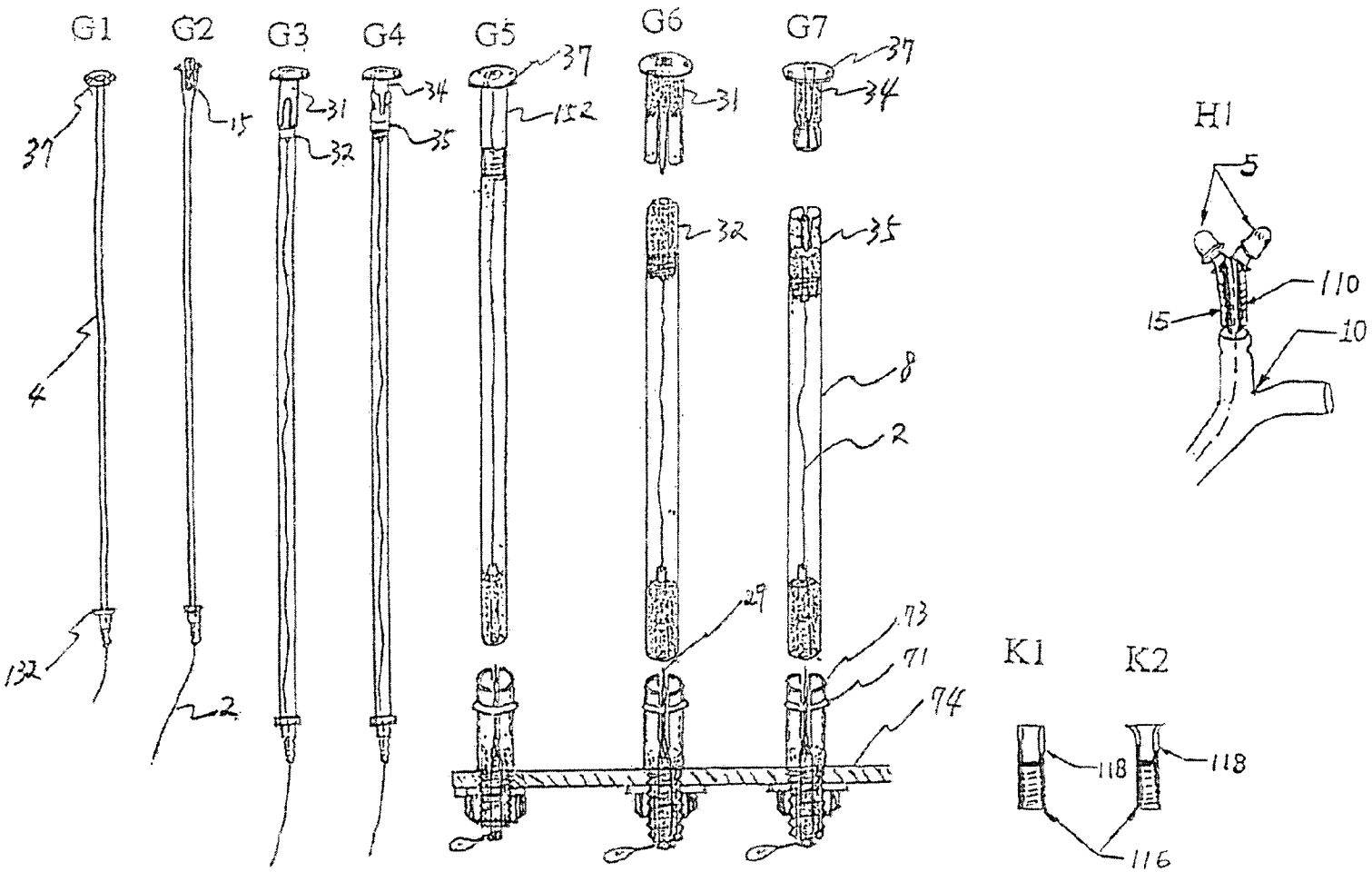
FIG. 48B is another schematic view showing various types of electrical connectors employed by the present invention.
Figure 50:
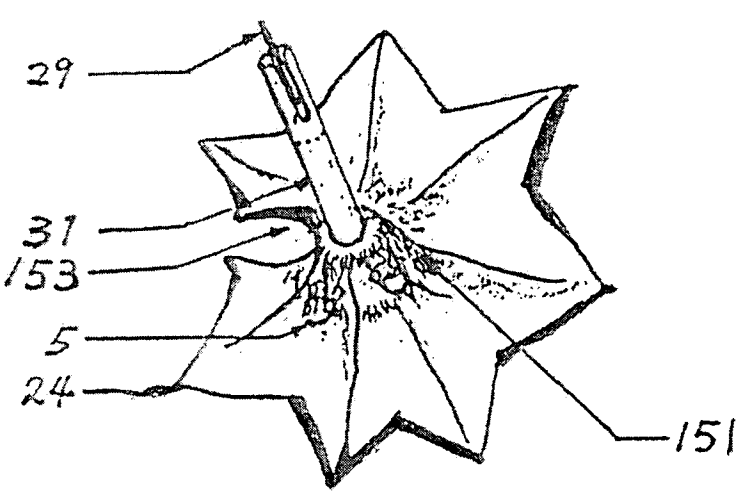
FIG. 50 is a rear view of FIG. 49.
Figure 49:
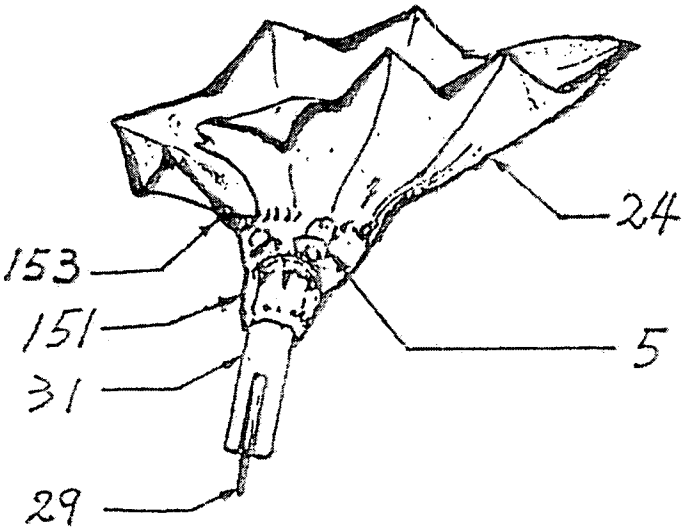
FIG. 49 is a front schematic view showing a U or V shaped aperture formed at the stalk of a heptagonal leaf.

Referring to FIGS. 1, 2, 3, 11, 12, 13, 14, 32, The main structure of the first embodiment comprises a plurality of automatically color variable LEDS 5 (or called multi-colored LEDS), metallic conductor branches 14, electrically insulated conductors 2, heat shrink bushings, or insulated tubular plugs, or internally or externally threaded tubular connectors 15 (see FIGS. 33, 34), a low voltage rectifier 12, base connectors 22, flowers 23, leaf blades 24, birds, fruits, butterflies, a molded coniferous Christmas tree (FIG. 10), and pots 13. The LED 5 is color variable. A plurality of LEDS 5 are sealed in a molded transparent resin structure formed between a leaf stalk 6 and a leaf blade, on a torus 1 beneath the center of the flower, or in the chest of a butterfly 19. In case the flower has no torus (such as orchid, daffodil, see FIGS. 44, 46), or the leaf blade has a narrow elongated leaf stalk (see FIG. 47). or the flower has a slim torus, a cone shaped or a funnel shaped molded transparent resin structure 151 may be formed beneath the rear of the leaf blade so as to accommodate the LEDS 5 and a PCB. For other types of leaf blades, such as colla lily, the plants with heptagonal leaves (see FIGS. 49, 50), *anthurium sherzerianum* (see FIG. 45), and a maple leaf (FIG. 45A), a cone or a funnel shaped molded transparent resin structure is formed at the bottom of the leaf stalk and provided with an aperture in correspondence with a U or V shaped aperture 153 along the leaf blade of a real plant. The leaf blade 24 (see FIG. 5), the flower 23 (see FIG. 6), the butterfly (see FIG. 7), the bird (see FIG. 8), the fruit (see FIG. 9), and the conferous Christmas tree (see FIG. 10), can all be formed with a molded resin structure to exhibit a colorful LED lighting variation on their surface. In order to enhance the degree of color and their silhouette, the molded transparent resin structure can be entirely or partially sand blasted to form a foggy (diffused) surface, or partially painted with color, or partially semi-transparently sprayed with color, so as to create an effect of layering color variation. Incidentally, the artificial butterfly feelers may employ optical fibers 40 affixed to its head.

Figure 29:
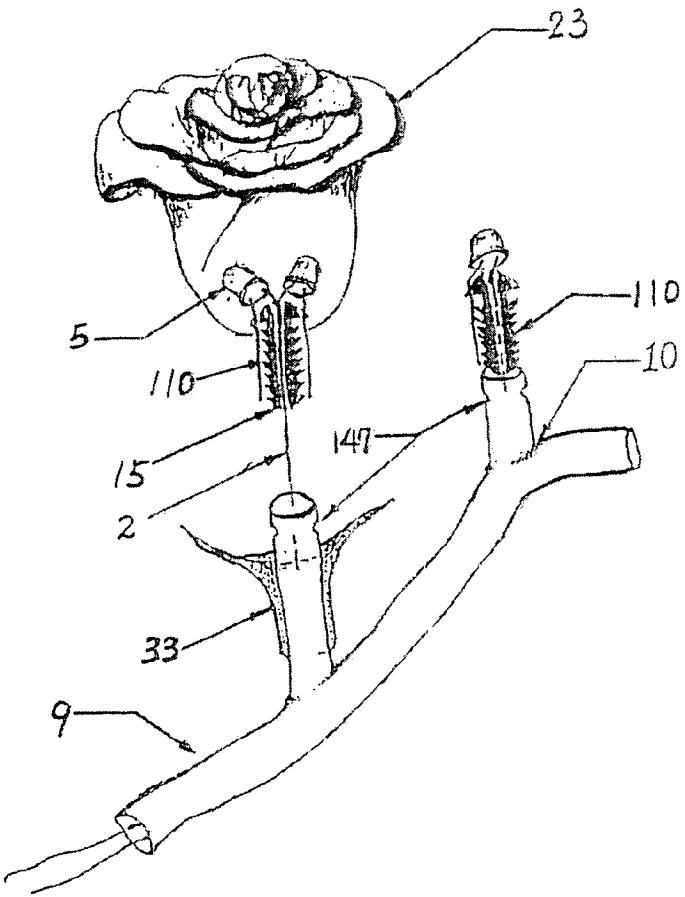
FIG. 29 is an illustrative view showing the method of inserting a heat resisting insulation plug into a copper tubular submain.
Figure 32:
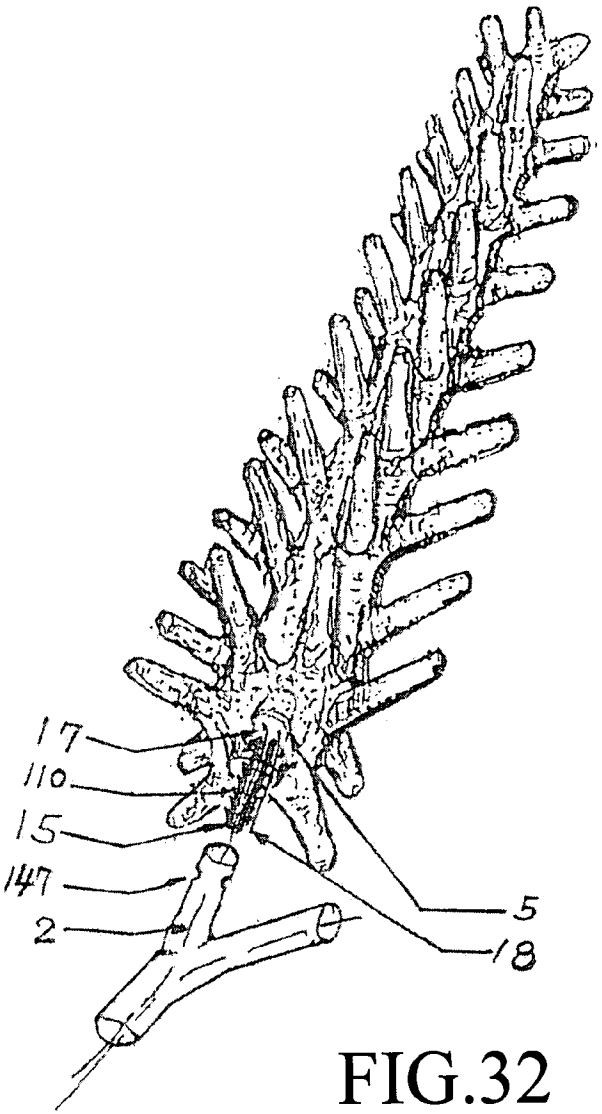
FIG. 32 is a schematic view of an artificial coniferous Christmas tree being fitted into a copper tubular branch with a heat resisting insulation plug.
Figure 31:
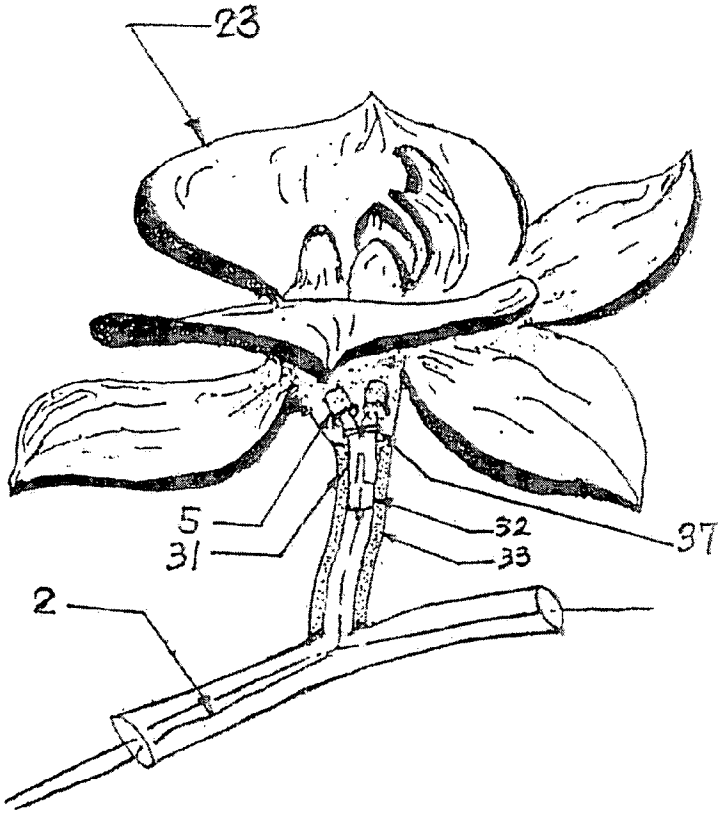
FIG. 31 is a schematic view of an artificial orchid being plugged in an A connector.

The plant trunk 8 and branch 9 of various flowers 23, leaf blades 24 fruits, butterflies, birds and Christmas trees formed of molded transparent resin structures are formed with metallic tubular submains 14 which are a plurality of flexible and various sized metallic copper conductor tubes, copper alloy tubes, or metal plated (silver or tin) tubes welded together. They can be bent into a desired angle and coated with various colored resins, a color resin paint or a resin and stone powder mixture 39 and then wrapped with a cotton tape to increase its diameter. The positive terminal pins 17 of the LED are welded to a slim electrically insulated conductor 2 and inserted into a heat shrink insulation bushing 15. After having been shrunk by heating, it is inserted into the metallic tubular submain 14 and fixed thereat. All slim electrically insulated conductors 2 are gathered at the lower chamber 26 of the pot via the metallic tubular submain 14 and welded to one terminal of the power supply switch, while the other terminal thereof is connected to the positive terminal of the base connector 22. The negative terminal pins 18 of the LEDS 5 are welded to the wall surface of the metallic tubular submain 14, so that the submain 14 becomes a negative side conductor. Alternatively, the positive terminal, Pins 17 of the LEDS 5 are twisted together and welded to a positive electric conductor 2 and passed through the middle pathway of the insulated tubular plug (see FIG. 29), while the negative terminal pins 18 of the LEDS 5 are respectively welded to the outer wall of the metallic tubular submain 14, or fixed to the outer wall of the insulation tubular plug and then plugged into the tubular submain 14. To prevent the plug from falling out, a check ring 110 is provided to the plug, or two indentations 147 (see FIG. 29) are formed by slightly punching the end of the tubular submain 14, or applying an externally or internally threaded set screw at the end of the submain 14 (see FIGS. 33, 34). One end of the conductor is welded to a welding terminal provided at the other end of the submain 14, while the other end of the conductor is welded to the negative terminal of the base connector 22. Using the internally and externally threaded set screw, or check ring to retain the tubular plug makes the structure of the present embodiment easy to construct with low cost.

Figure 13:
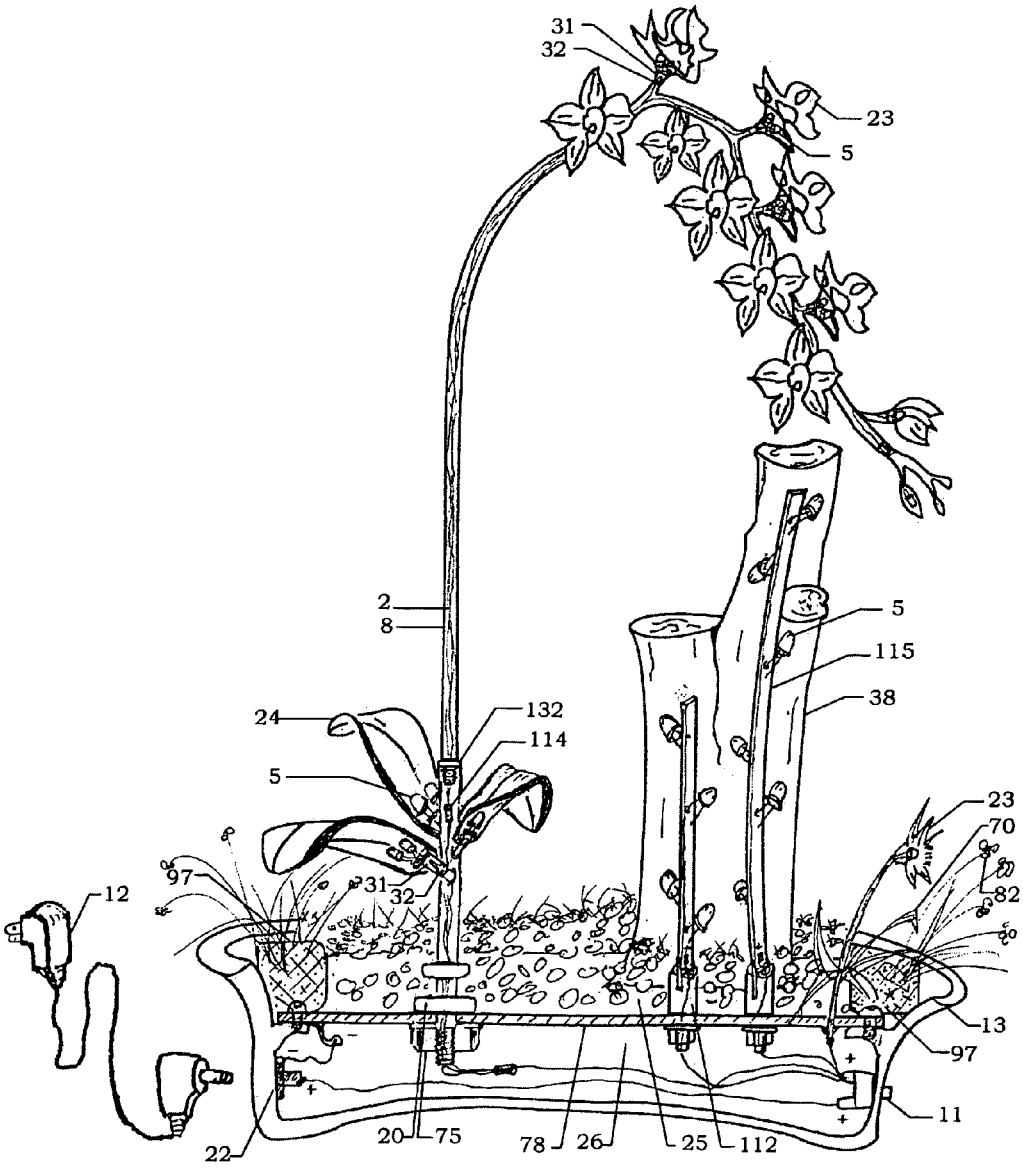
FIG. 13 is a schematic view of a potted orchid plant with LEDS.
Figure 14:
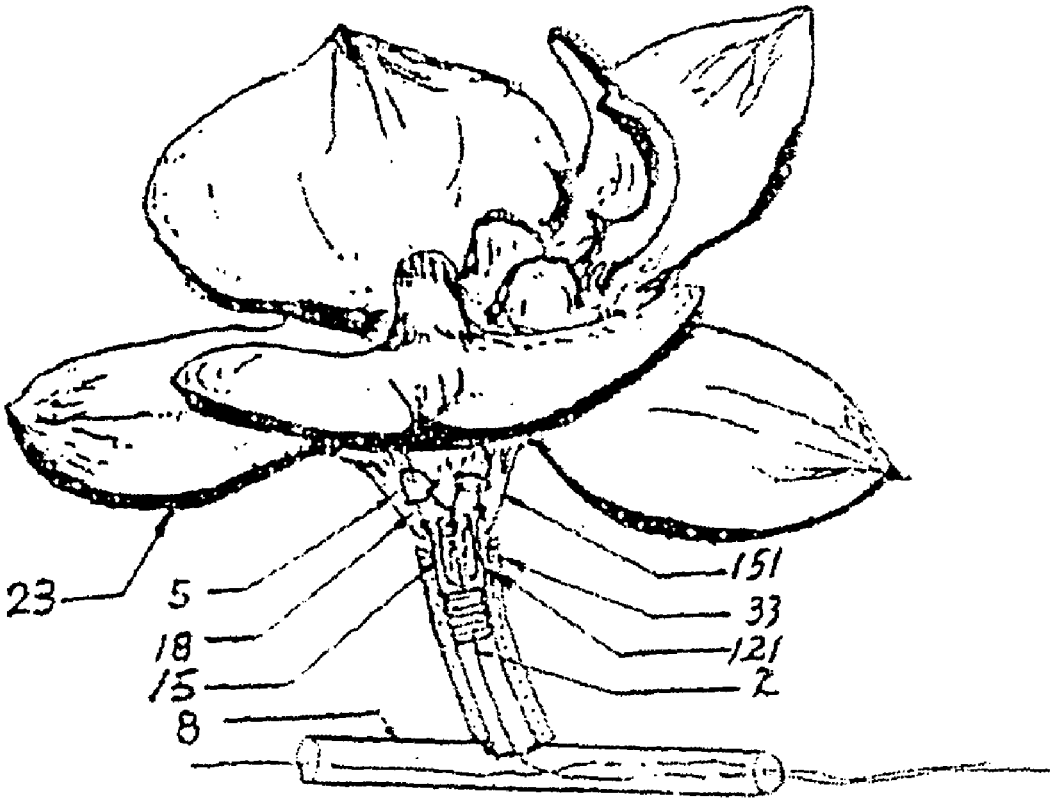
FIG. 14 is a schematic view showing an artificial orchid with LEDS.
Figure 15:
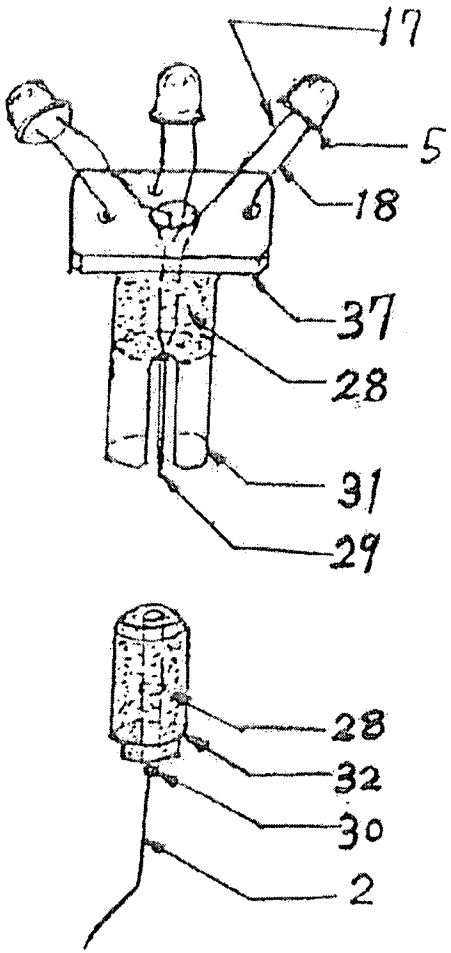
FIG. 15 is a schematic view showing a group of LEDS and an A connector.

As shown in FIGS. 1, 2, 3 and 19, the branch 9 and the trunk 8 may be assembled section by section using a combination of male and female copper alloy joints 132, and then filling the clearance with soft silicon rubber that is then coated with a colored resin paint. The trunk 8 has two flanges 20 at a bottom portion thereof, and is set in the upper chamber 25 with the mixture of the resin and ballast material. The power is supplied to the LEDS 5 from a power supply switch 11 through a low voltage rectifier 12. With this arrangement, as shown in FIGS. 13 and 14 a novel, delicate and exquisite decorative artificial potted plant display with three dimensionally variable colored LEDS 5 can be created in which the leaf blade 24, the flower 23, the butterfly, the bird, the fruit, and the Christmas tree can all be formed into a molded resin structure to exhibit a vivid colorful lighting variation. The degree of color and the silhouette of the display is intensified by entirely or partially sand blasting the above molded transparent resin structure 38. Besides, the extra artifacts made of the mixture of resin and stone powder added to the plant display further increase exquisiteness.

Embodiment 2

Figure 1:
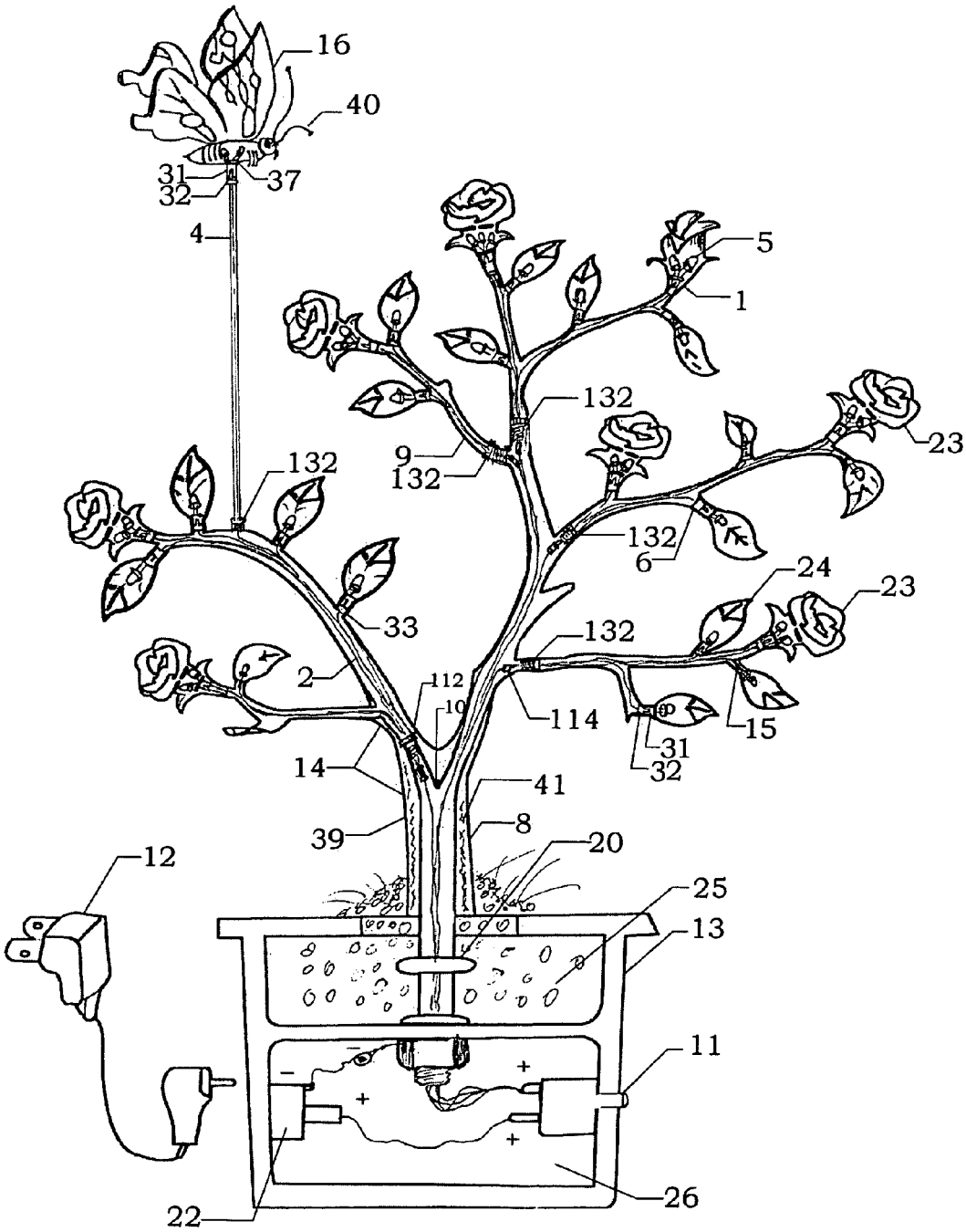
FIG. 1 is an assembly view of a potted plant with flowers and a butterfly resting on a flower corolla.
Figure 2:
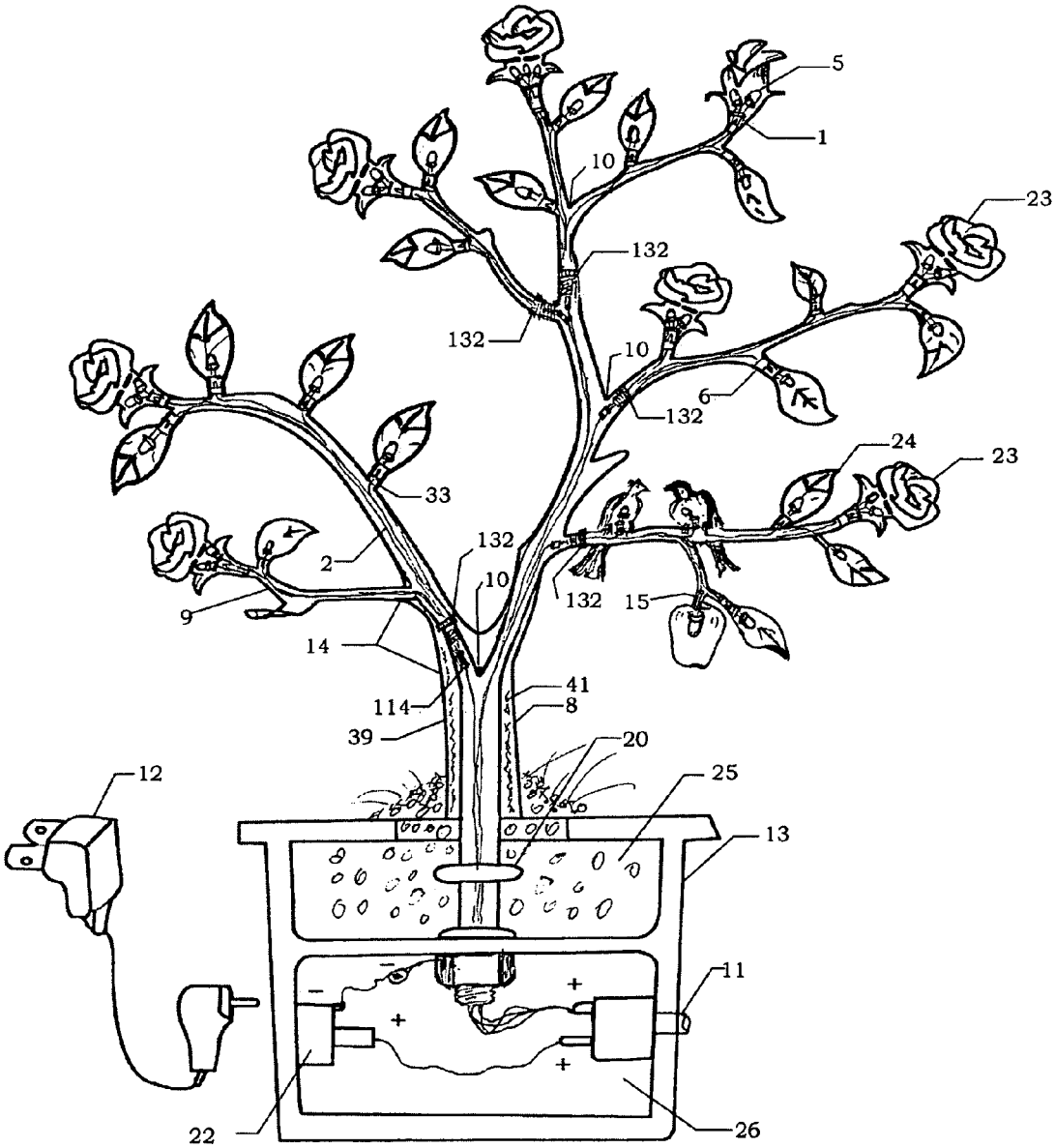
FIG. 2 is an assembly view of a potted plant with flowers, fruits and birds perching on a tree branch.
Figure 3:
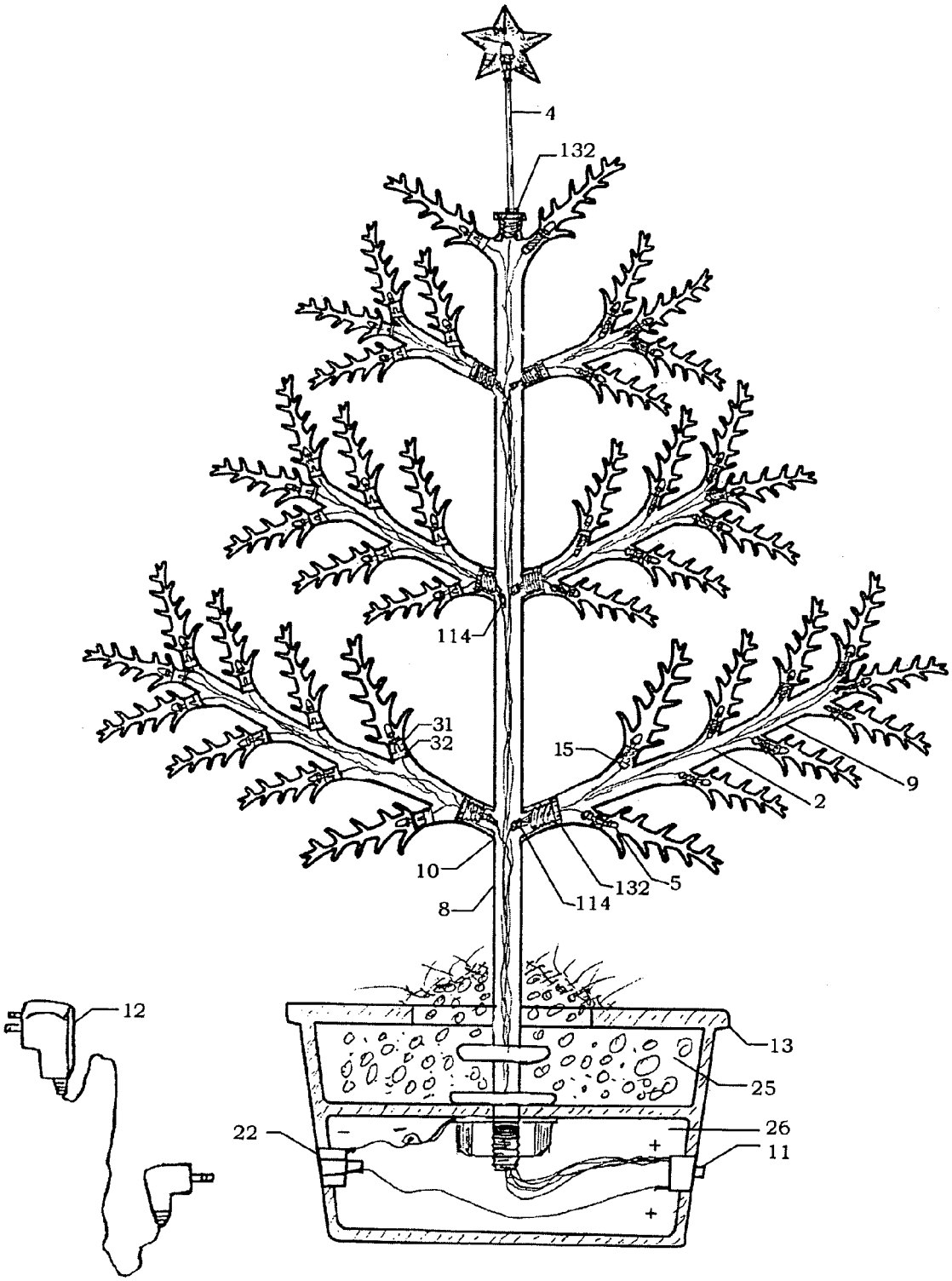
FIG. 3 is a schematic view of a potted Christmas tree.
Figure 4:
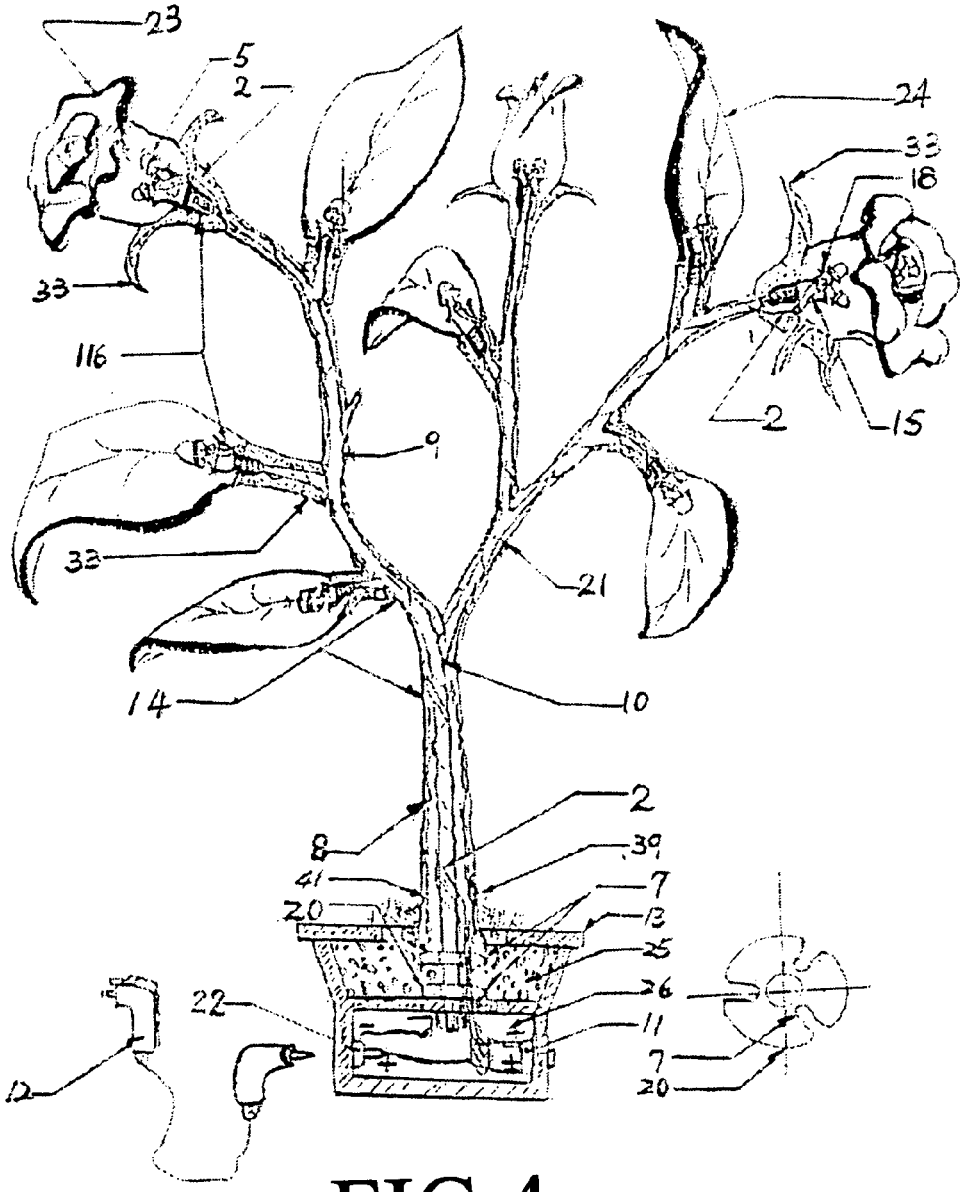
FIG. 4 is a schematic view showing the assembled structure of a pot with solid copper conductors with flanges.
Figure 30:
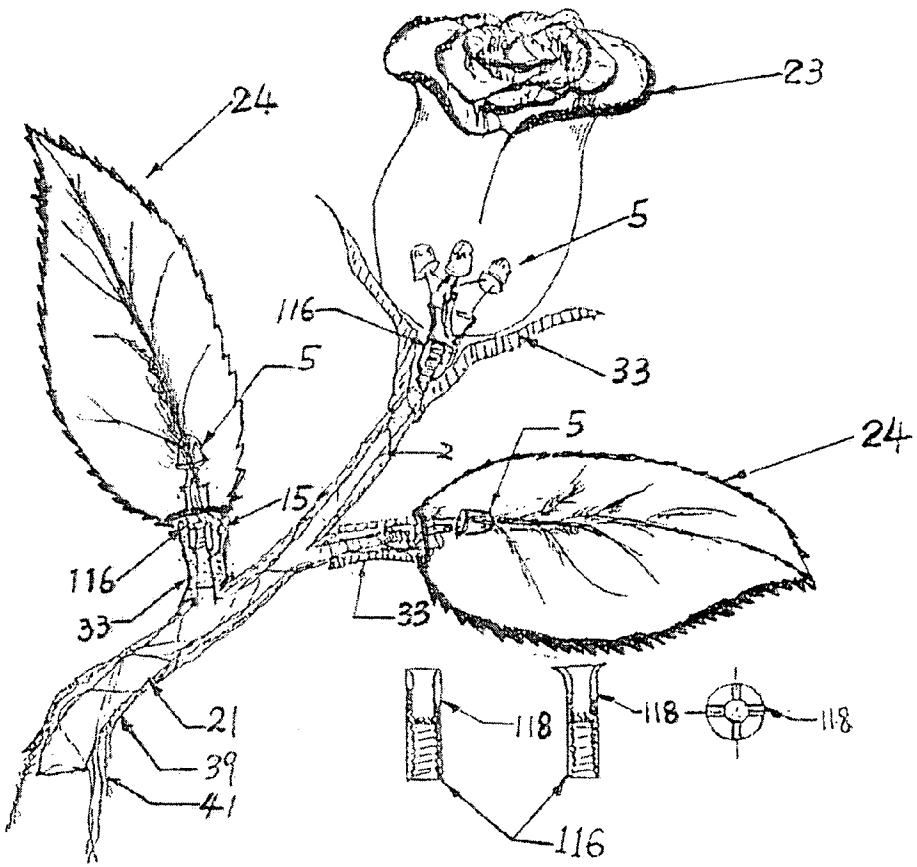
FIG. 30 is an illustrative view showing the method of fitting a solid copper branch into an internally threaded copper alloy connector.

Referring to FIG. 4 in this embodiment, the plant trunk 8 and branch 9 of the metallic tubular submain 14 are formed of a plurality of flexible various sized copper bars. The slim electrically insulated conductor 2 passes through the large aperture 118 opened at the upper portion of an internally threaded copper alloy connector 116 (see FIG. 30) and twists along the submain 14 to enter the pot. The diameter of the submain is enlarged by wrapping the electrically insulated conductors 2 with a cotton tape 41 and the copper bar 21 with several layers, and then coating with colored resin paint or the mixture of resin paint and a stone powder mixture 39.

The slim electrically insulated conductors 2 connected to one terminal of LEDS 5 are connected to the positive terminal of the power supply switch 11 provided at the base of the lower pot chamber 26 via three apertures 7 opened on the two flanges. The other negative terminal pins of the LEDS 5 are welded to the small apertures 118 formed in the copper alloy conductors 116 which are screwed onto the copper bars 21 forming the metallic tubular submain 14, so that the submain 14 serves as a negative conductor. The welding terminal plate provided on the copper bar at the trunk bottom is the other terminal of the submain 14. A conductor which is welded to the submain 14 has its other end welded to the base connector 22 in the lower pot chamber 26, so as to serve as a negative terminal and thereby provides the means for the leaf blades 24, the flowers 23, the fruits and the birds coupled to the submain 14 to exhibit a variety of color change.

Embodiment 3

Referring to FIGS. 15, 17, 19 and 31, in this embodiment, the present invention comprises the LEDS 5, the metallic tubular submain 14, the electrically insulated conductors 2, a PCB 37, an insulation material 28, positive terminal pins 29, an inner tube 30, an A connector 31, a colored soft plastic bushing 33, an A receptacle 32, flowers 23, leaf blades 24 fruits, butterflies of a molded transparent resin structure, and pots 13. The plant trunk 8 and branches 9 of the metallic tubular submain 14 are a plurality of flexible and various sized metallic copper conductor tubes, copper alloy tubes, or metal plated (silver or tin) tubes welded together. They can be flexed into a desired angle and coated with various colored resin paints, or a resin and stone powder mixture 39 and then wrapped with a cotton tape 41 to increase its diameter.

Wherein the positive terminal pins 17 of the LEDS 5 are connected in parallel or are individually welded to the pin holes formed on a copper foil at the upper surface of the PCB 37. The negative terminal pins 18 of the LEDS 5 are welded to the negative side pin holes of the copper foil formed on the rear edge surface of the PCB 37. The positive terminal pins of the LEDS 5 and the positive terminal pins 29 are mutually connected, but the housing of the A connector 31 and the positive terminal pins 29 are isolated by the insulation material 28.

The A connector 31 is fitted into the A receptacle 32 with the positive terminal pin 29 inserted into the inner tube 30. The lower end of the inner tube 30 is welded to the electrically insulated conductor 2 so as to form a positive tube conductor. The bottom edge of the A receptacle 32 is welded or threadedly engaged to the metallic tubular submain 14 so as to provide a negative conductor. Then afterwards, the LEDS 5 are sealed in the molded transparent resin structure and the colored soft plastic bushing 33 is compressed onto the A connector 31 and the A receptacle 32. In this version, the molded structure of the flowers and leaves can be efficiently replaced or their position changed, if desired.

Embodiment 4

Figure 16:
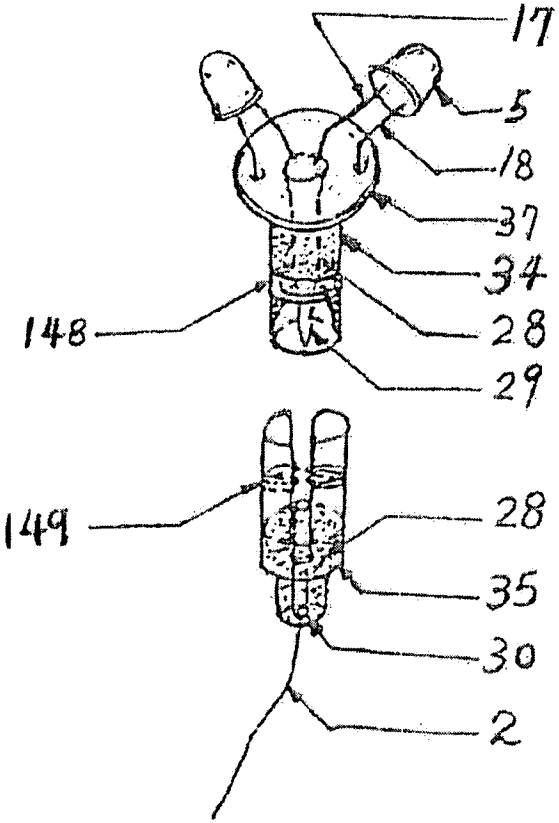
FIG. 16 is a schematic view showing a group of LEDS and a B connector.
Figure 17:
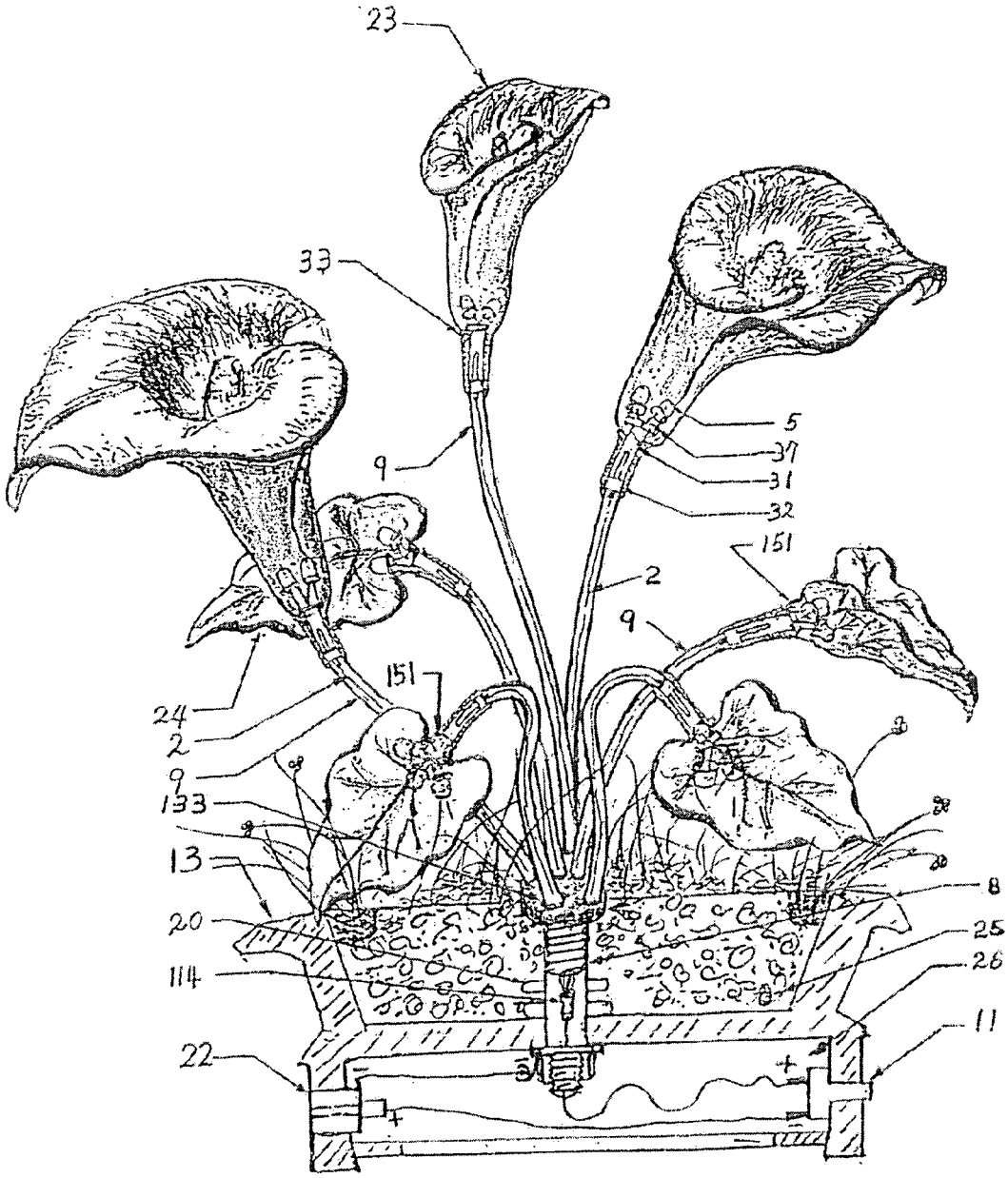
FIG. 17 is a schematic view showing a potted plant of calla lily flowers connected with A connectors.
Figure 18:
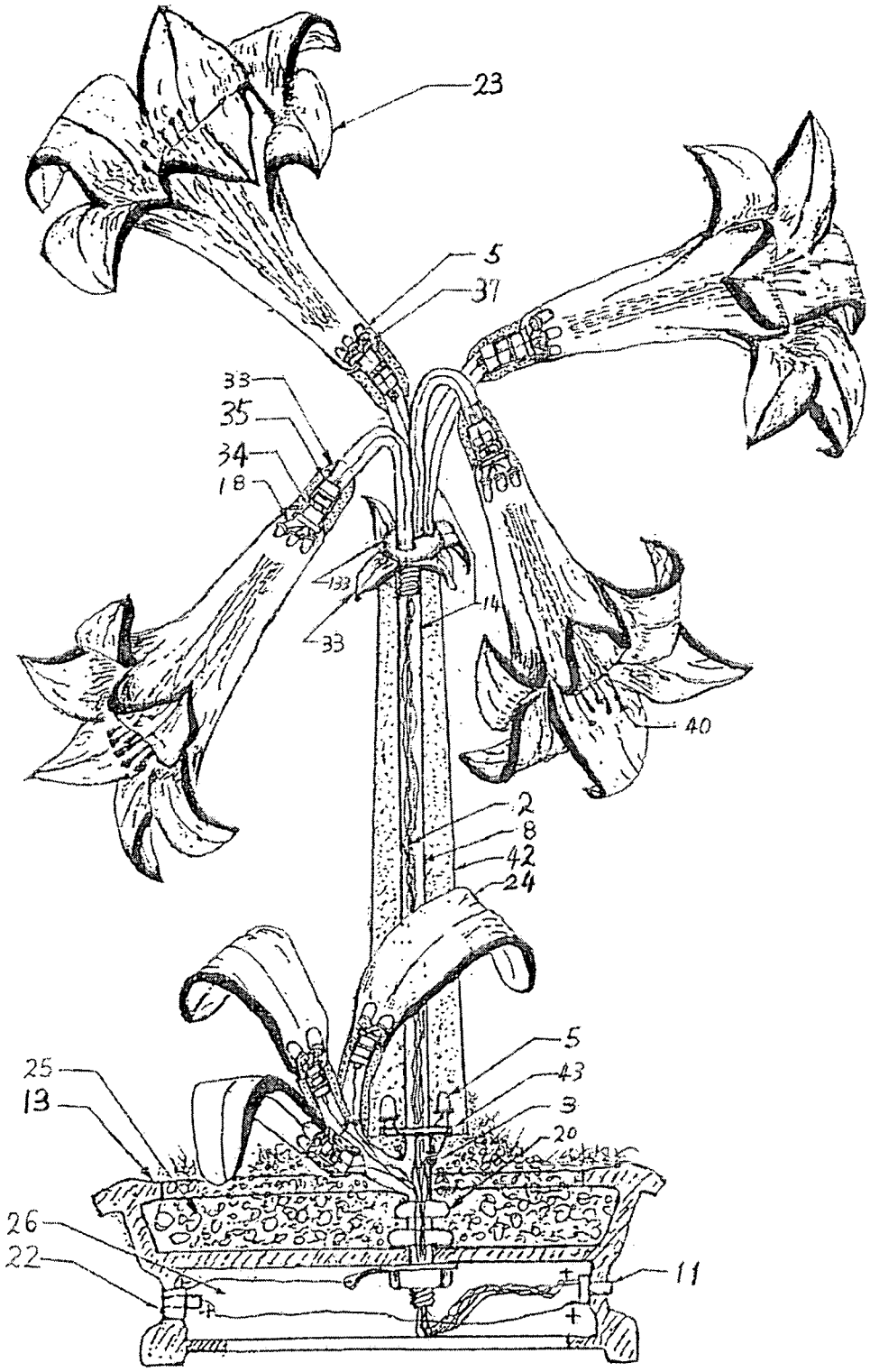
FIG. 18 is a schematic view showing a potted plant of hyacinth flowers connected with B connectors.
Figure 19:
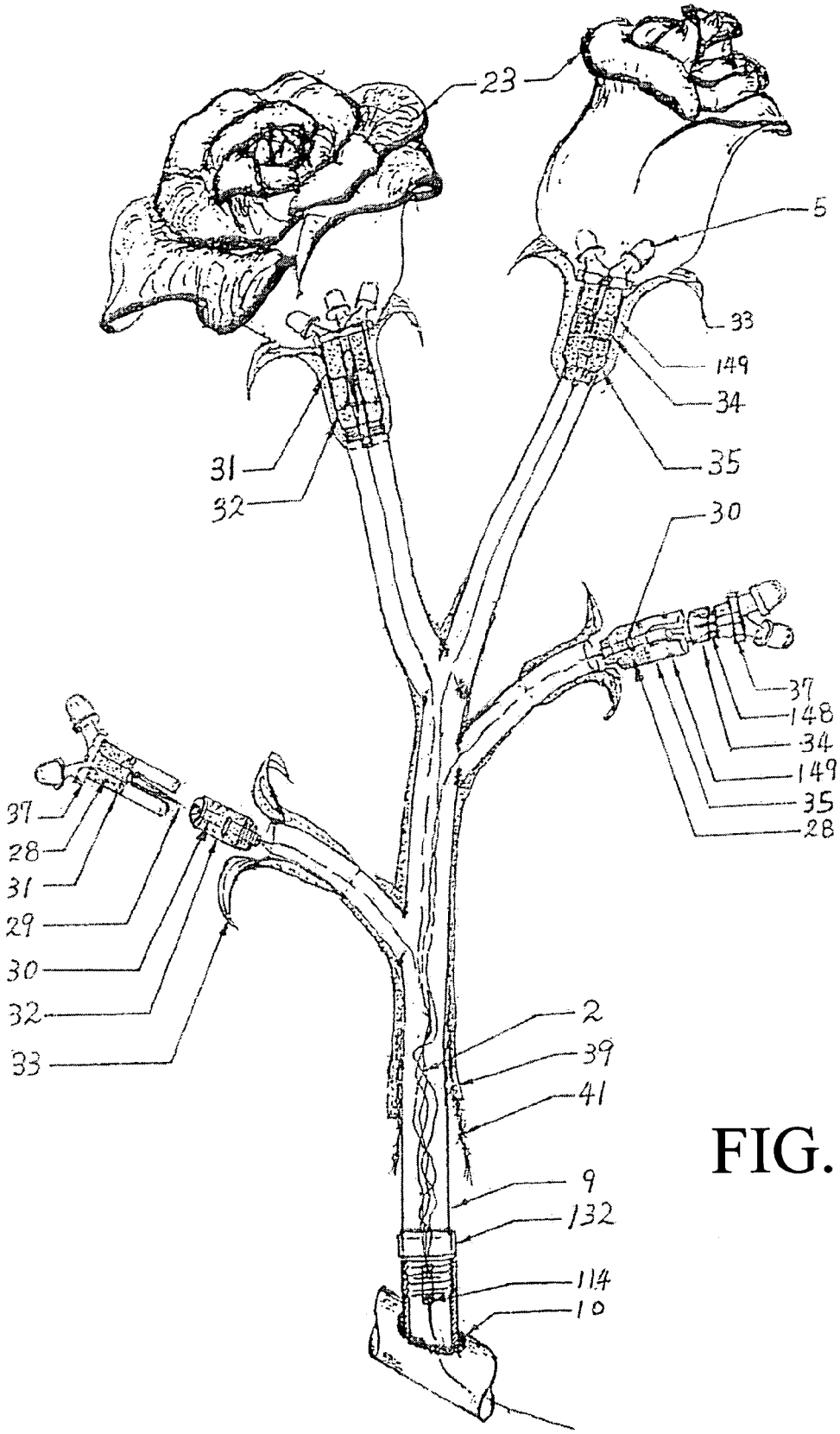
FIG. 19 is a schematic view showing a potted plant of rose flowers connected with both A and B connectors

Referring to FIGS. 16, 18 and 19, in this embodiment, the present invention comprises a plurality of automatically color variable LEDS 5, flowers 23, leaf blades 24, birds, fruits, butterflies, metallic conductor branches 14, electrically insulated conductors 2, PCB 37, insulation material 28, positive terminal pins 29, inner tube 30, B connector 34, colored soft plastic bushing 33, B receptacle 35, and pots 13. The B connector 34 and a B receptacle 35 in which a groove 148 is formed along the outer edge of the B connector 34, is inlaid into a flange 149 formed in the B receptacle 35. The trunk 8 and the branches 9 are both coated with the colored resin paint, or the trunk 8 is covered by a molded structure formed of the mixture of the resin and the stone powder 42 (see FIG. 18). Here, the PCB 43 is welded to the bottom outer wall of the trunk 8 to connect the negative terminal pins of the LEDS 5 to the surface of the trunk 8 via a negative copper foil. A positive copper foil provided at the outer edge of the PCB 43 is welded to a positive conductor together with the positive terminal pins of the LEDS 5 and inserted into a small aperture 3 formed on the bottom surface of the trunk 8. A pistil 40 formed of an optical fiber (see FIG. 18) is connected to and stuck at the center portion of the molded flower structure near the head of the LEDS 5. The color light is directed by the optical fiber to its exposed round head.

Wherein the positive terminal pins 17 of the LEDS 5 are connected in parallel and welded to the pin holes formed on a copper foil at the upper surface of the PCB 37 for connection to the corresponding terminal pin 29. The negative terminal pins 18 of the LEDS 5 are welded to the negative side pin holes of the copper foil formed on the rear edge surface of the PCB 37. The positive terminal pins 17 of the LEDS 5 and the positive terminal pins 29 are mutually connected, but the housing of the A connector 31 and the positive terminal pins 29 are isolated by the insulation material 28.

The B connector 34 is fitted into the B receptacle 35 so as to insert the positive terminal pin 29 into the inner tube 30. The lower end of the inner tube 30 is welded to the electrically insulated conductor 2 so as to form a positive tube conductor. The bottom edge of the B receptacle 35 is welded or threadedly engaged to the metallic tubular submain 14 so as to provide a negative conductor. Then afterwards, the LEDS 5 are sealed in the molded transparent resin structure and the colored soft plastic bushing 33 is compressed onto the B connector 34 and B receptacle 35. In this version, the molded structure of the flowers and leaves can be efficiently replaced or their position changed, if desired.

Embodiment 5

Figure 20:
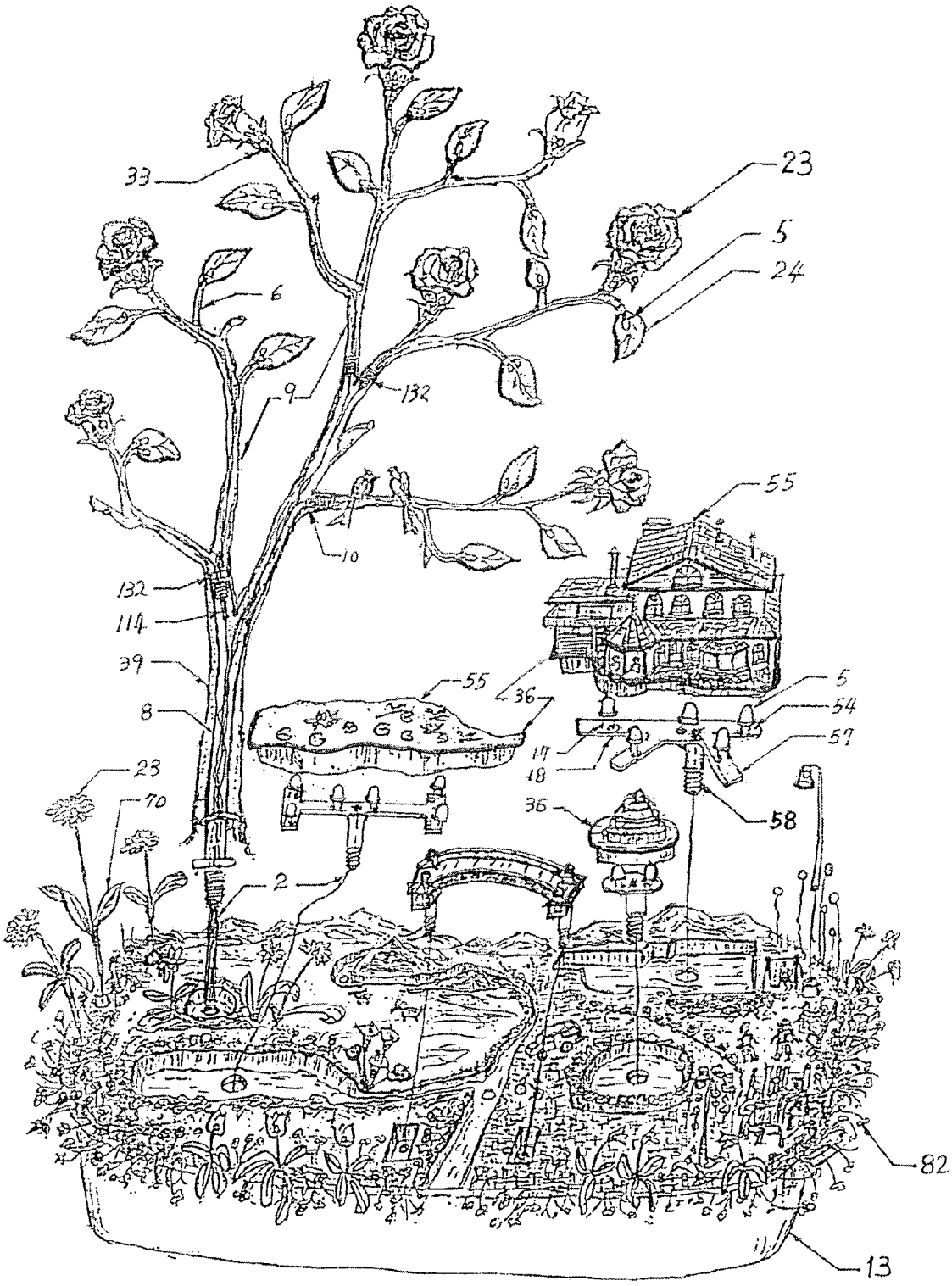
FIG. 20 is an exploded view of a medium or large size potted plant.
Figure 21:
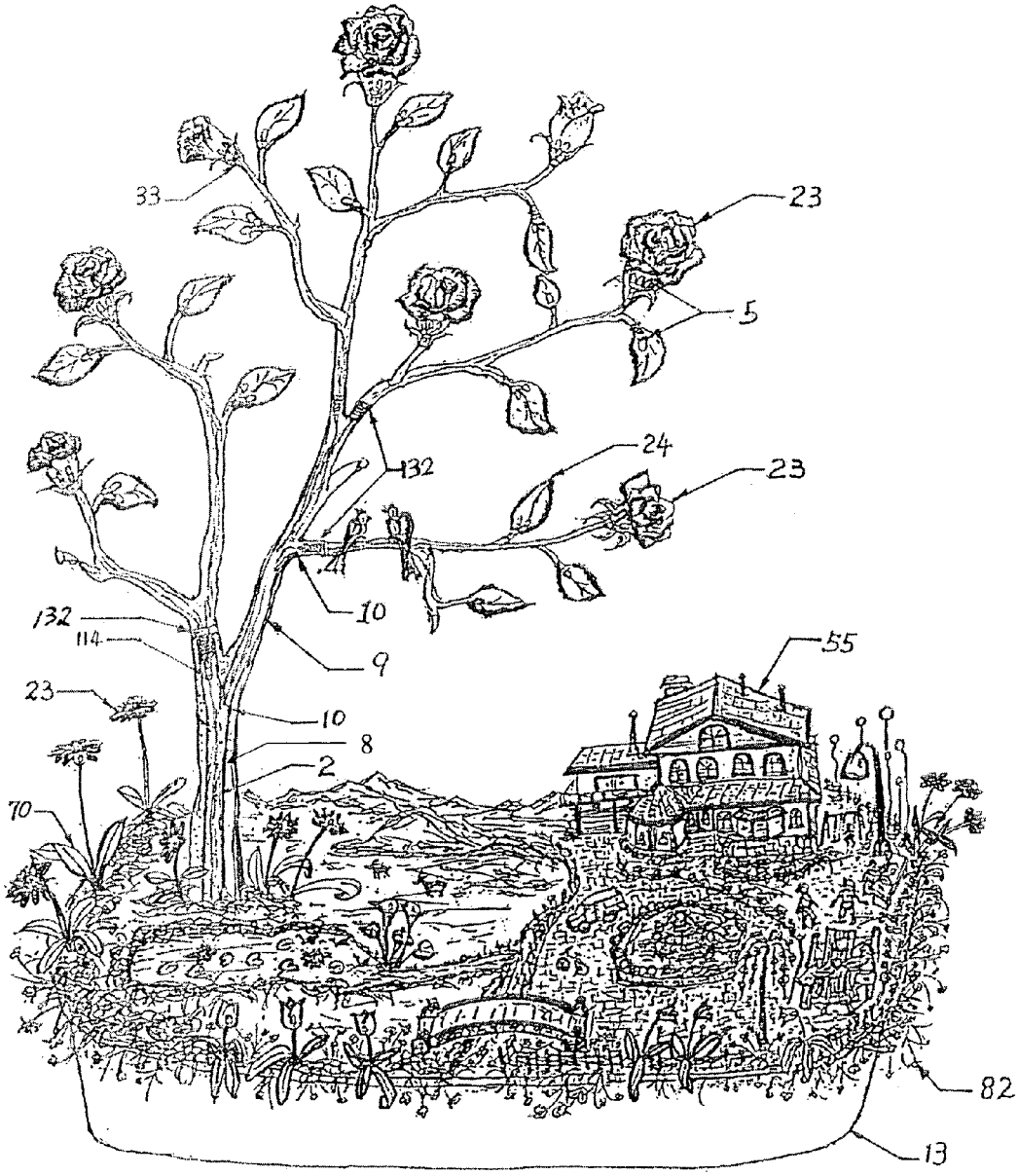
FIG. 21 is an assembly view of medium or large size potted plant.
Figure 22:
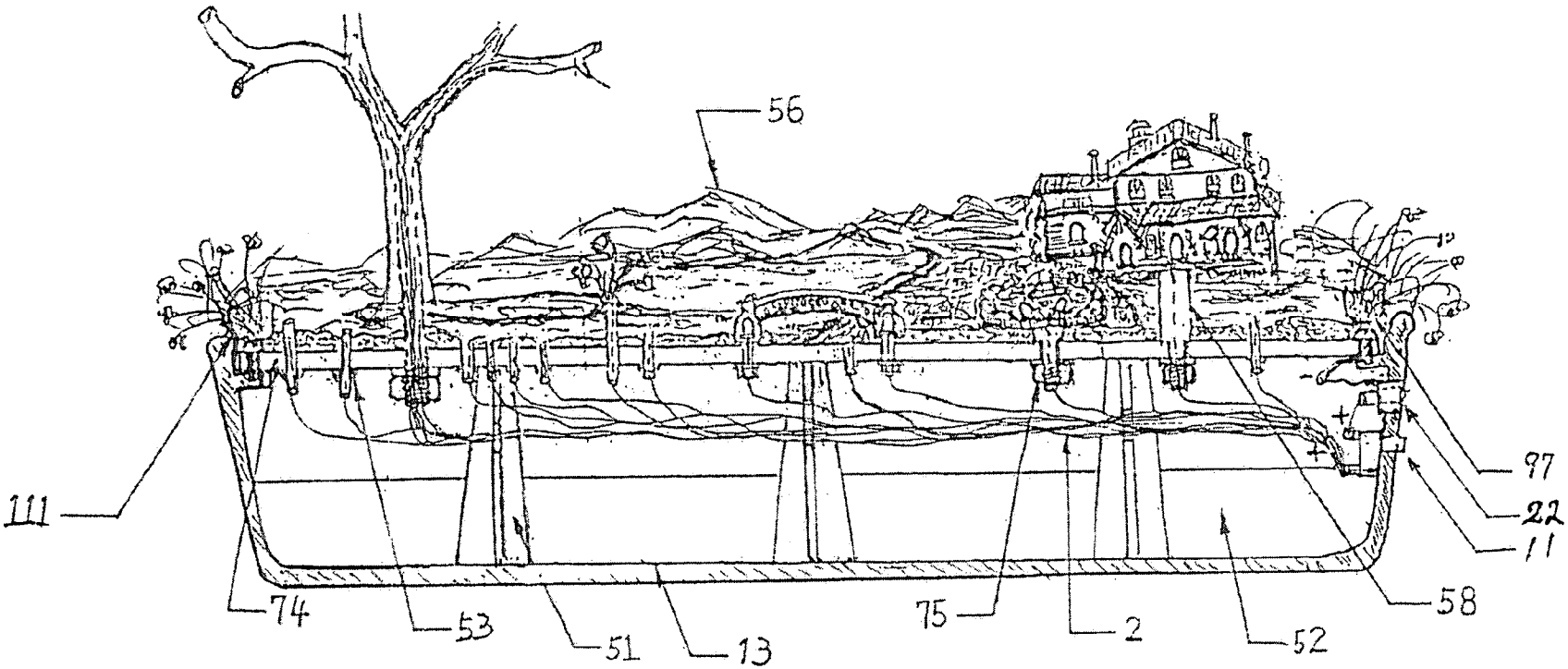
FIG. 22 is a schematic view showing an electrical circuit layout in the rear of a pot.

Referring to FIGS. 20 through 22, this embodiment is composed of a plurality of automatically color variable LEDS 5, flowers 23, leaf blades 24, birds, fruits, butterflies, metallic conductor branches 14, electrically insulated conductors 2, negative metallic base plate 74, A connector 31, A receptacle 32, B connector 34, B receptacle 35, artifact 55, miniature landscape 56, and pots 13, the plant trunk 8 and branches 9 of various flowers 23, leaf blades 24 fruits, birds and trees formed, the embodiment 3 using the A connector 31 and the A receptacle 32 and the embodiment 4 using the B connector 34 and the B receptacle 35. A colored miniature landscape 56 is molded with mixture of resin, stone powder and fiberglass, the artifact 55 thereon is made of a molded transparent resin structure with LEDS 5. The clearance between the flange 36 around the artifact 55 and an indentation around the upper edge thereof is filled with a soft resin and is painted with a color. For decoration of the miniature landscape 56, instead of a sponge groove 111, a plurality of slim vines are inserted on a sponge 97 so as to serve as a hanging ornament 82 (see FIG. 21).

Wherein the positive terminal pins 17 of the LEDS 5 are connected in parallel and welded to the pin holes formed on a copper foil 54 at the upper surface of the PCB 57. The negative terminal pins 18 of the LEDS 5 are welded to the negative side pin holes of the copper foil formed on the rear edge surface of the PCB 57.

A copper tube 58 is welded to the negative copper foil of the PCB 57 to serve as a negative conductor. The terminal pin of the copper tube 58 passes through the miniature landscape 56 and is fixed to a negative metallic base plate 74 with a nut and washer combination 75. The negative metallic base plate 74 is sustained on the pot by stands 51 and a barrier plate 52 (see FIG. 22).

Embodiment 6

Figure 23:
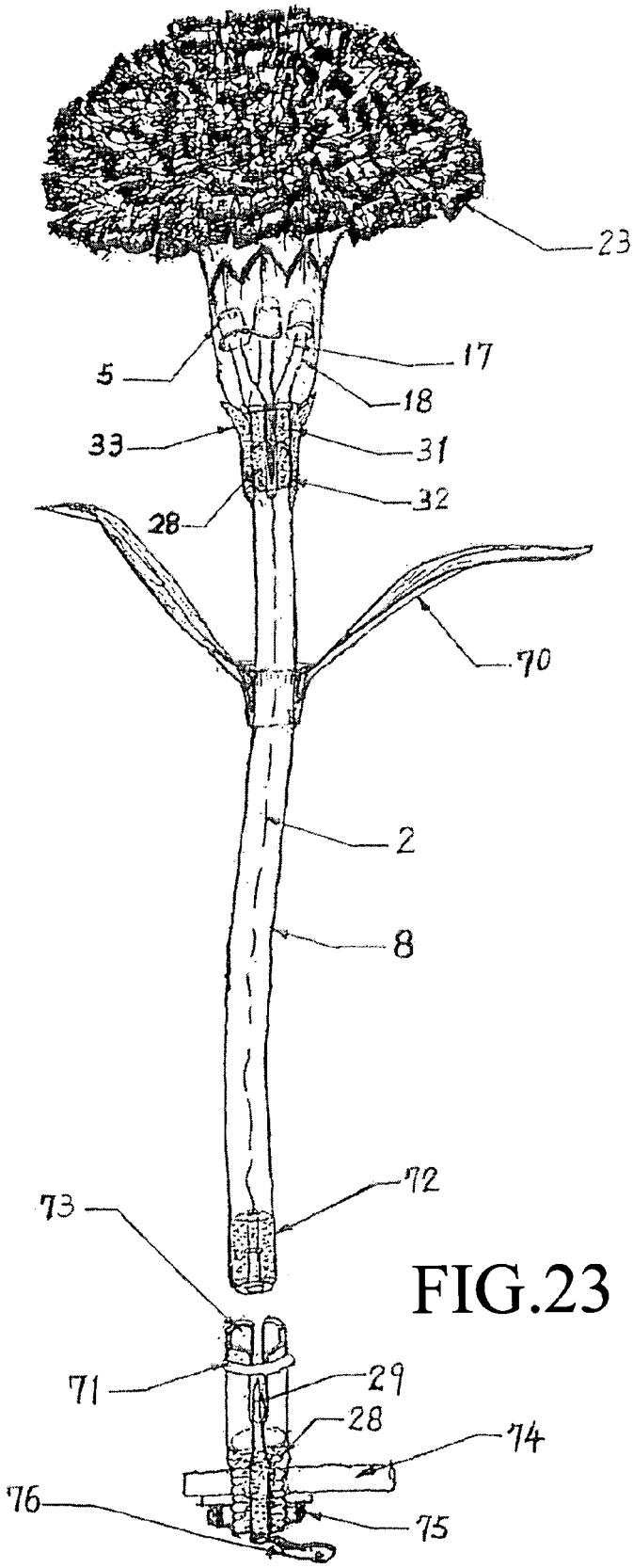
FIGS. 23 and 23A are schematic views showing how the flowers of a medium or small size potted plant are assembled.
Figure 23A:
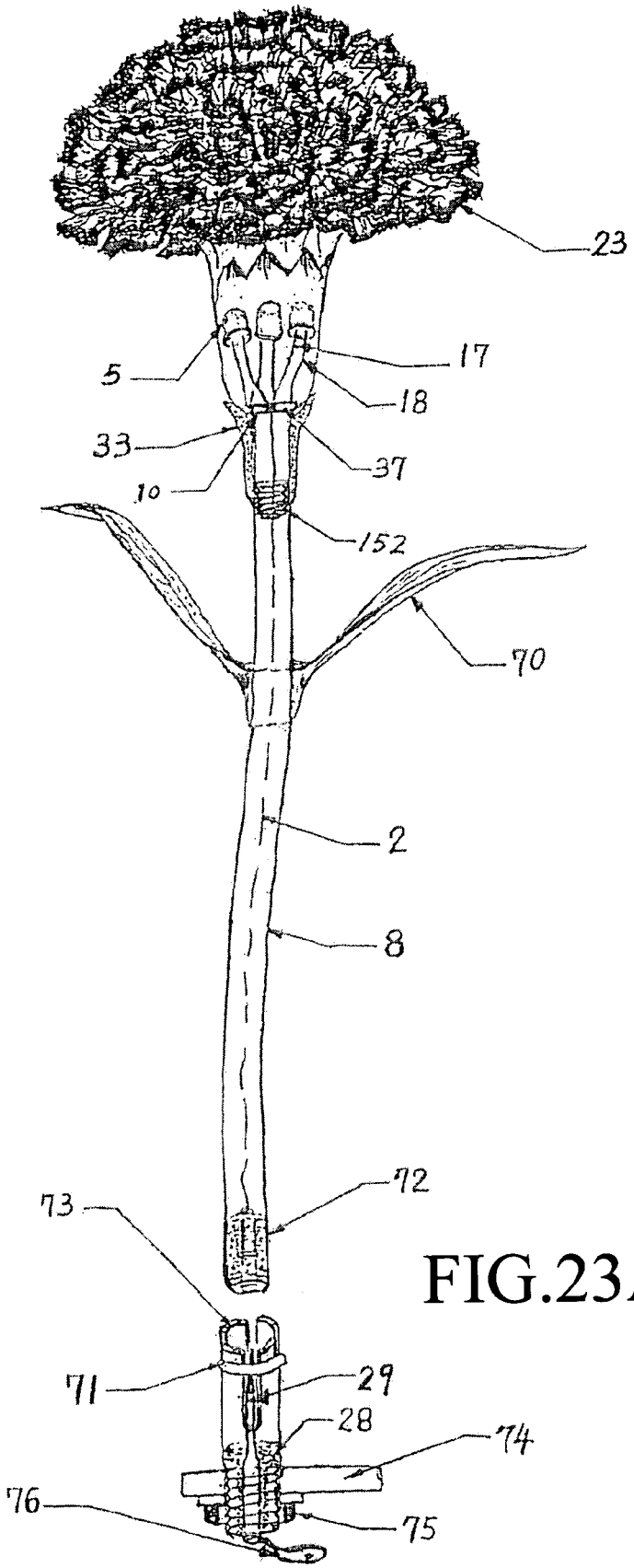
Figure 24:
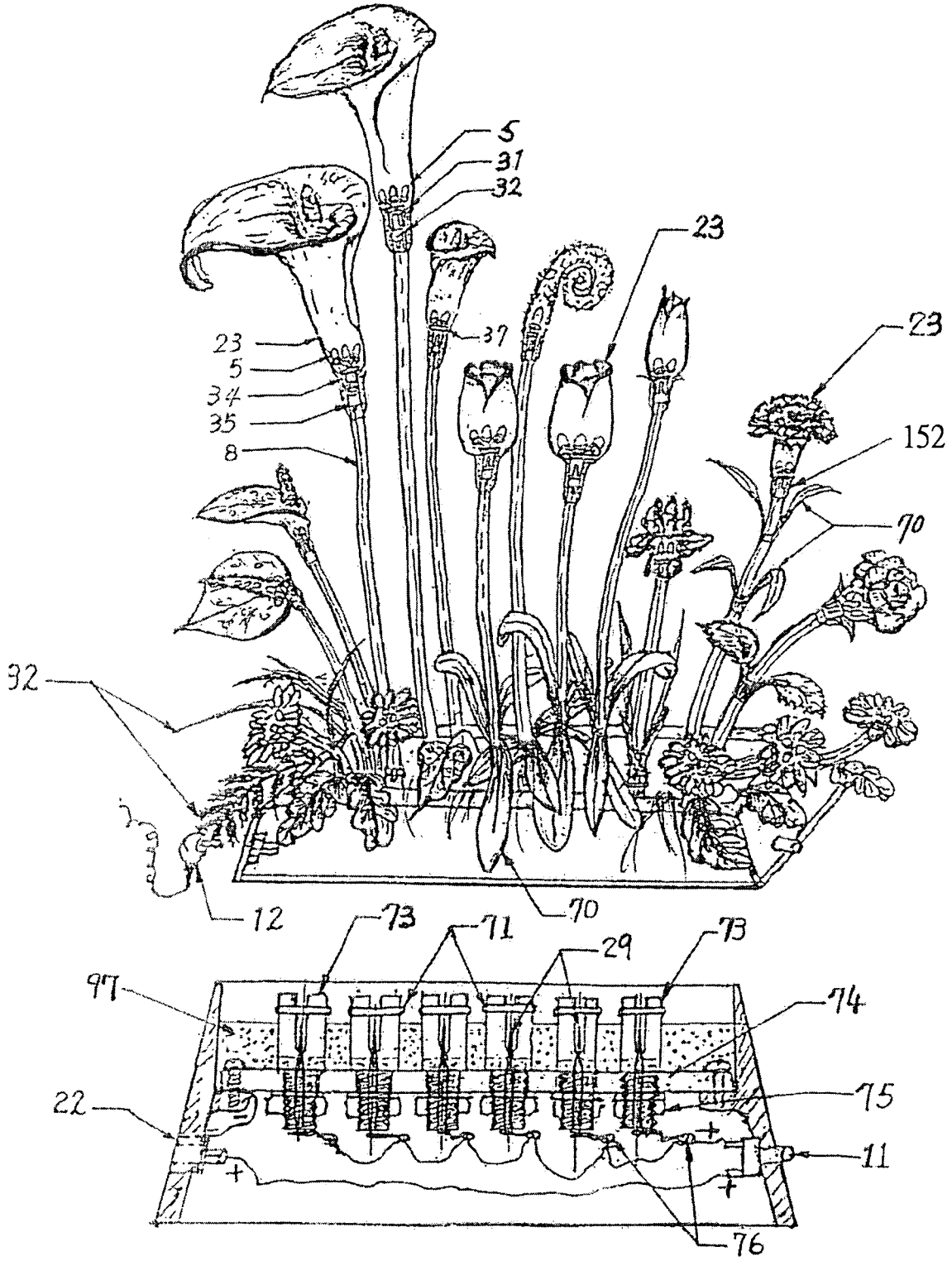
FIG. 24 is an assembly view of a medium or small size potted plant (1)

Referring to FIGS. 23 and 24, this embodiment is composed of a plurality of automatically color variable LEDS 5, decorative foliage 70, A connector 31, A receptacle 32, B connector 34, B receptacle 35, coil spring 71, receptacle 72, negative copper alloy tube 73, negative metallic base plate 74, washer combination 76, the LEDS 5 are a combination of embodiments 3 and 4. The positive and negative terminal pins of the LEDS 5 enclosed in the molded structure are respectively welded to the positive and negative copper foil of the PCB 37, which is coupled to a C1 connector 152, and then the C1 connector 152 is threadedly engaged, (or may use an externally threaded connector 121) to the upper portion of the trunk 8 (see FIG. 23A). The trunk 8 which sustains the flower 23 or other equivalents, may have its root portion fit into a receptacle 72, whose inner hole is jointed to the positive terminal pins 29 of the negative copper alloy tube 73. A welding terminal plate belonging to the positive terminal pins 29 is connected to the power supply switch 11.

The trunk 8 supports a decorative foliage 70 at its top, and its root is inserted into the negative copper alloy tube 73 which is fixed with a nut and washer combination 76 to a hole formed on the negative metallic base plate 74, and the root of the trunk 8 and the negative copper alloy tube 73 are firmly pressed together with a coil spring 71. With this arrangement, the trunk 8 holding various flowers and foliage can be sustained on the pot.

Figure 51A:
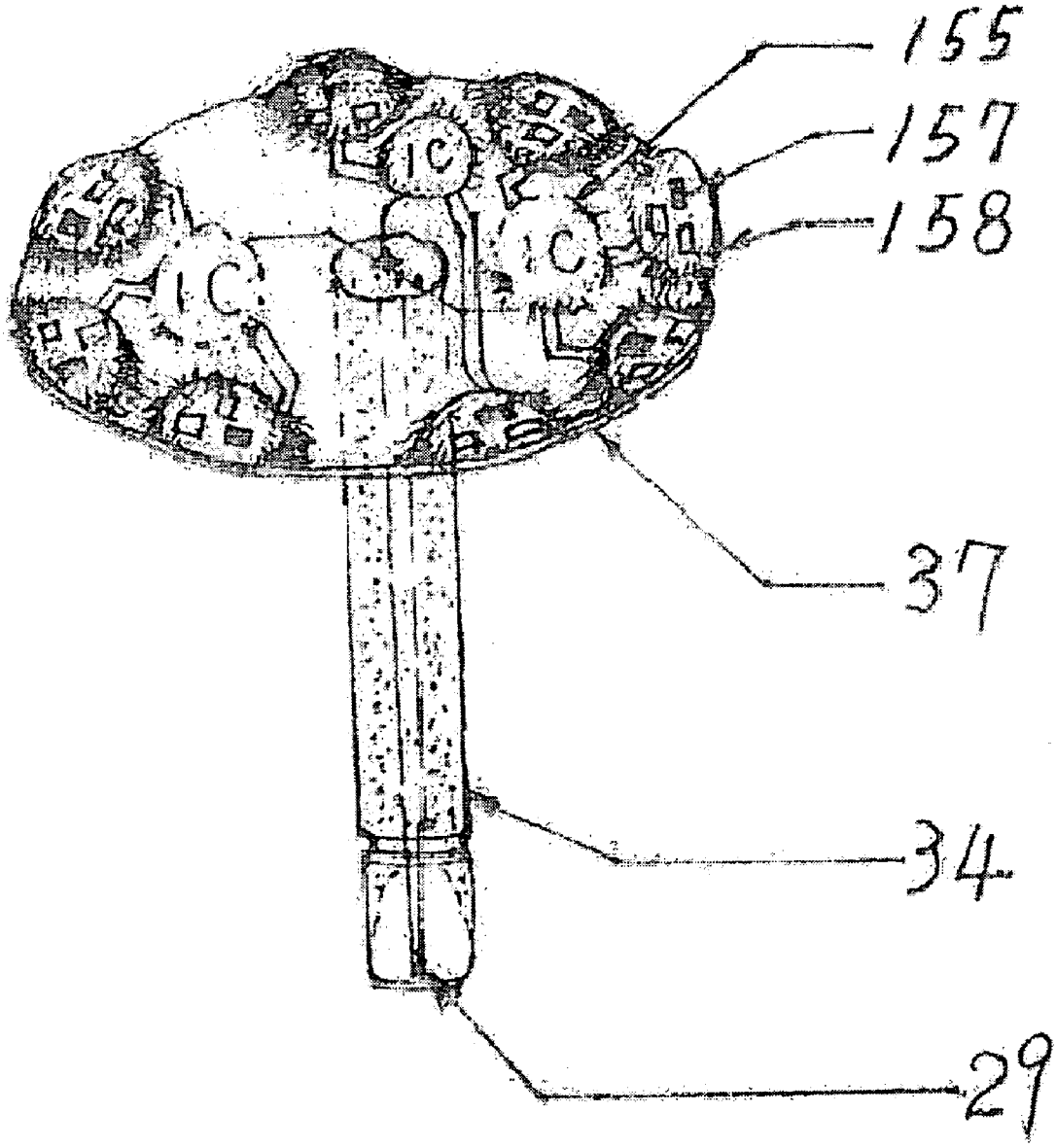
FIG. 51A is a schematic assembly view showing a multi-colored light element composed of a plurality of R.G.B original color light emission dies and its control IC on a PCB and then connected to an A type connector according to the present invention.
Figure 51B:
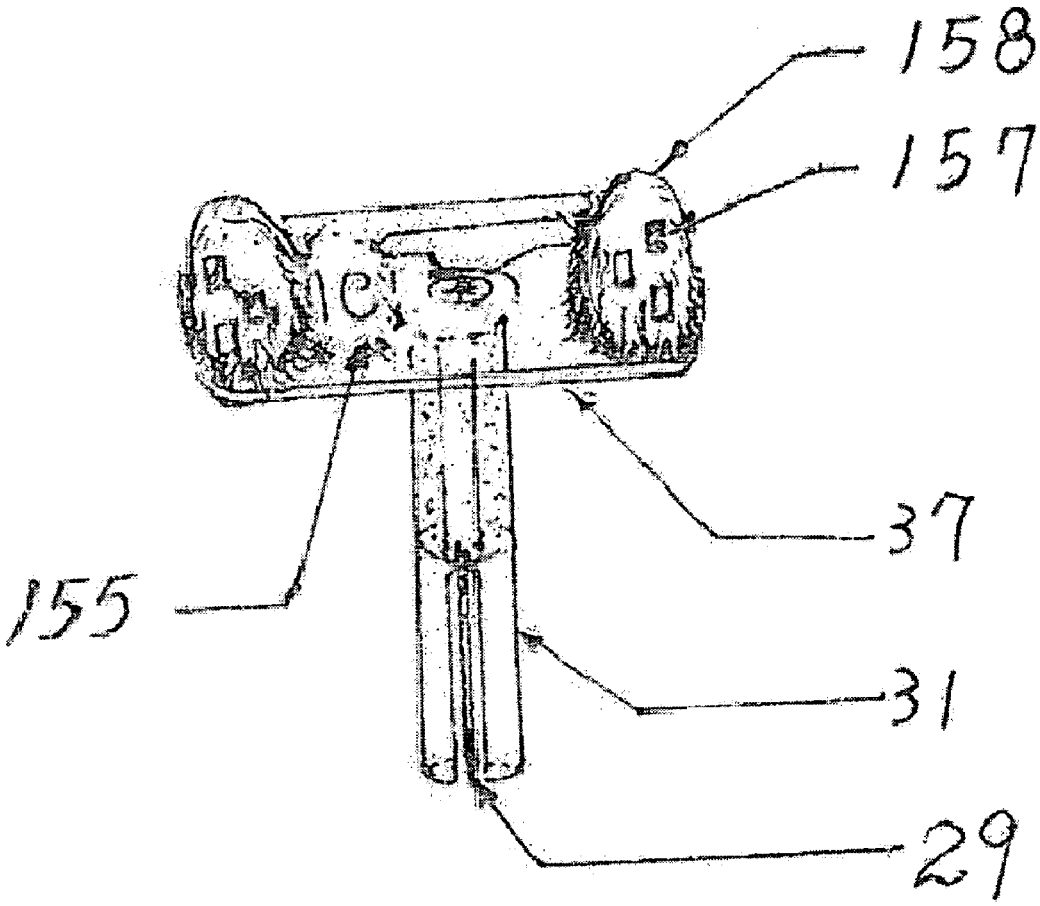
FIG. 51B is a schematic assembly view showing a multi-color light element composed of a plurality of R.G.B original color light emission dies and its control IC on a PCB and then connected to a B type connector according to the present invention.
Figure 52:
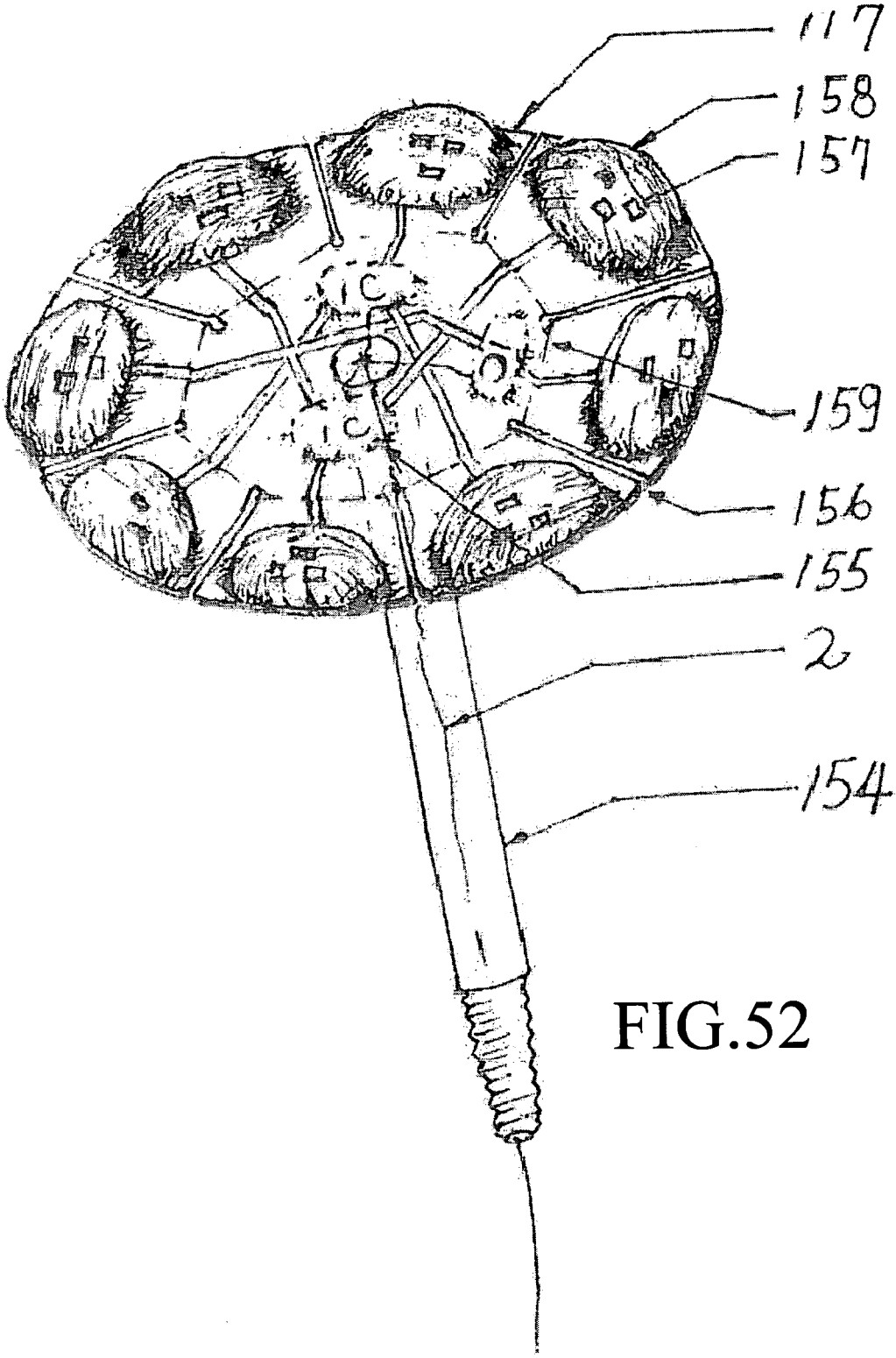
FIG. 52 is a schematic assembly view showing a multi-color light element composed of a plurality of R.G.B original color light emission dies and its control IC on an FPC and then connected to a threaded tubular connector according to the present invention.

Referring to FIGS. 51 through 52, in order to shorten the time required for welding the colored LEDs 5 on the PCB 37 or the FPC 117 and facilitate sealing them in the molded transparent resin structure, a reduced number of terminal pins of most of the LEDs 5 are provided. Instead, a plurality of R.G.B original color light emission dies 157 and their control IC 155 are implanted by silver soldering directly on the PCB 37 or the FPC 117, using automatic insertion. Subsequently, both the light emission dies 157 and the control IC 155 are covered with an epoxy resin cover 158 formed into a semi-spherical light focusing structure or a rectangular light diffusing structure having a convex portions. The negative copper foil formed on the rear surface of the PCB 37 or the FPC 117 is welded to the upper terminal of an internally or externally thread tubular connector, an A type connector 31, or a B type connector. Alternately, it can be bolted to or fitted into the submain tube end. In order to adjust a light projection angle, scored lines 156 and fold lines 159 are provided on the FPC substrate 117.

Embodiment 7

Figure 25:
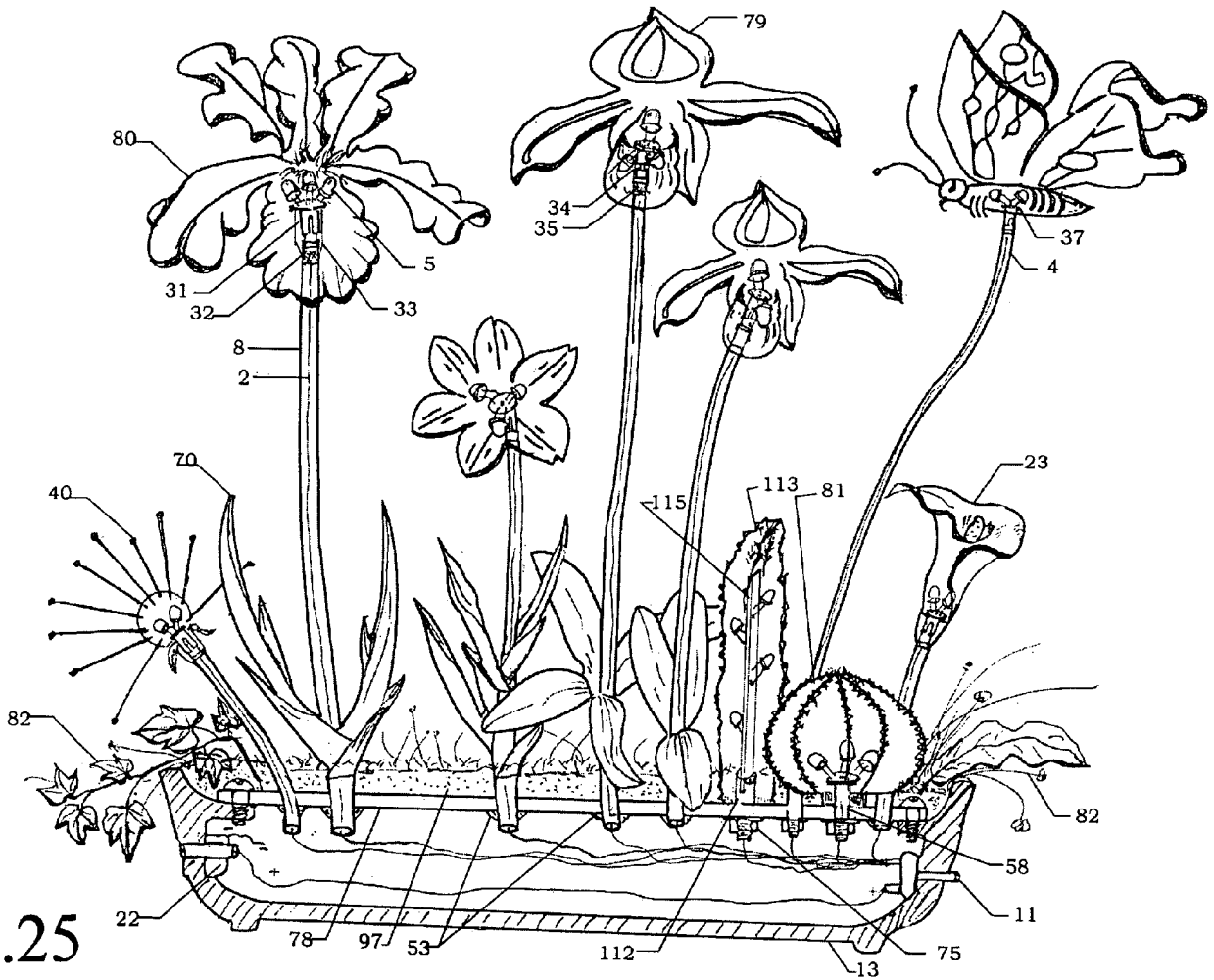
FIG. 25 is an assembly view of a medium or small size potted plant (2)
Figure 26:
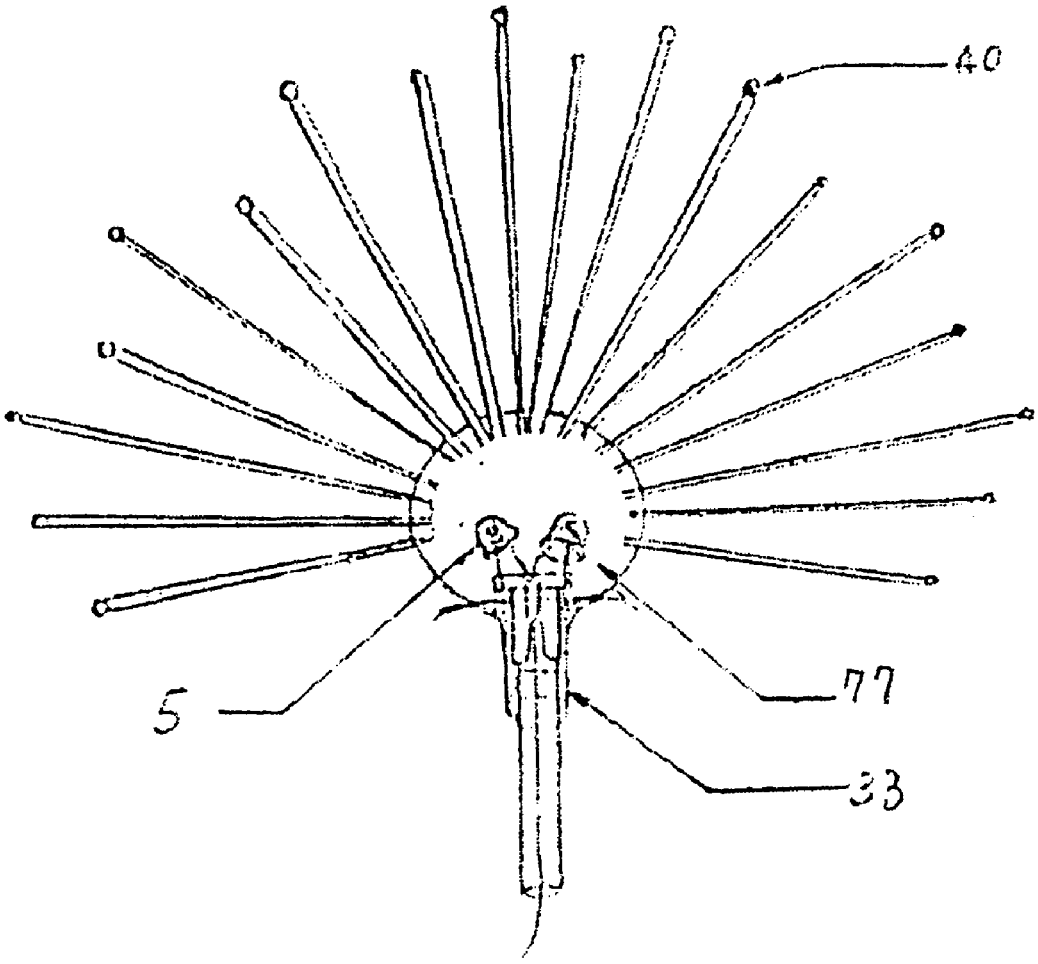
FIG. 26 is a schematic view showing a spruce and LEDS connected with optical fibers.
Figure 26A:
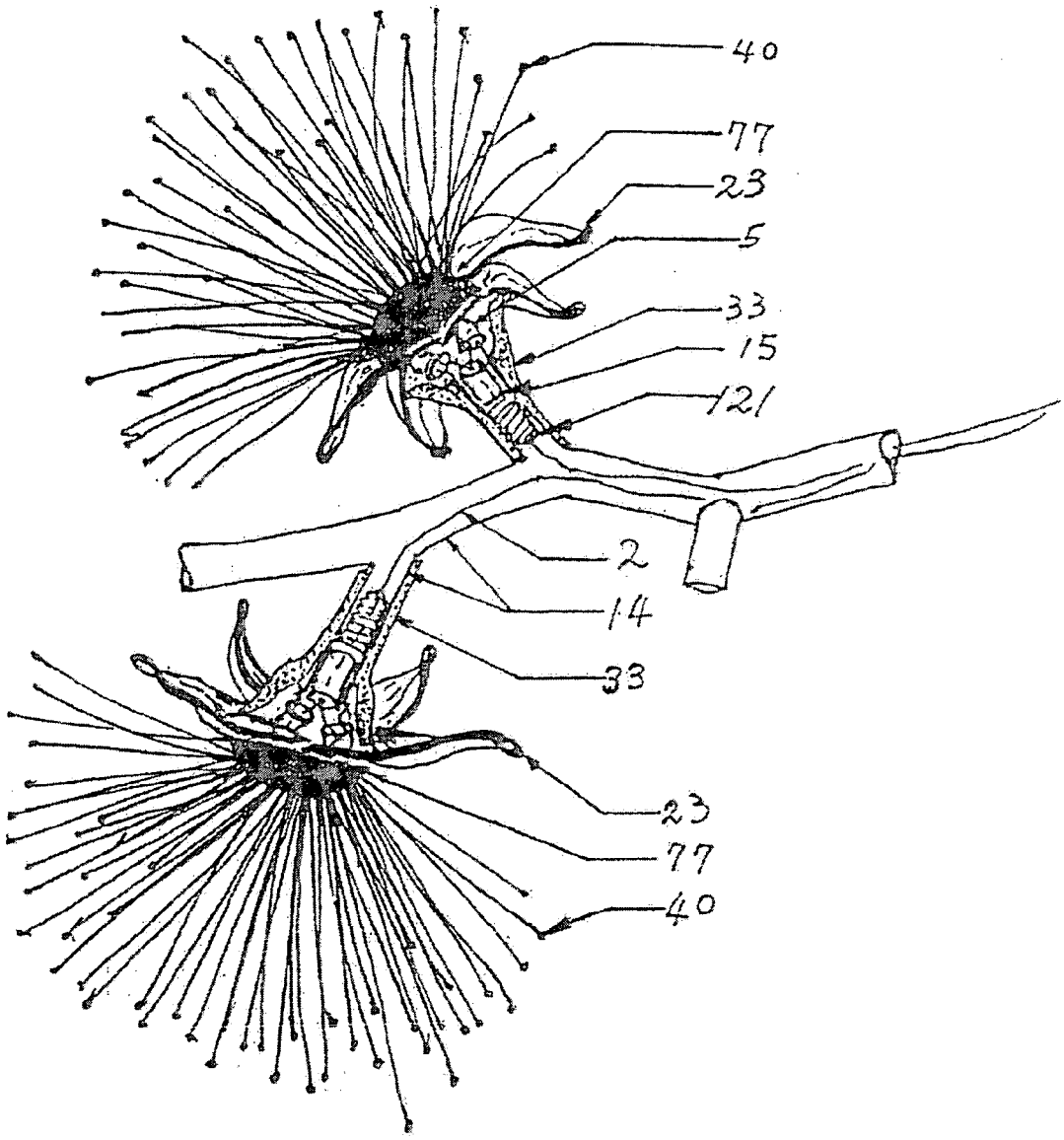
FIG. 26A is a schematic view showing two flowers connected with optical fibers.
Figure 43:
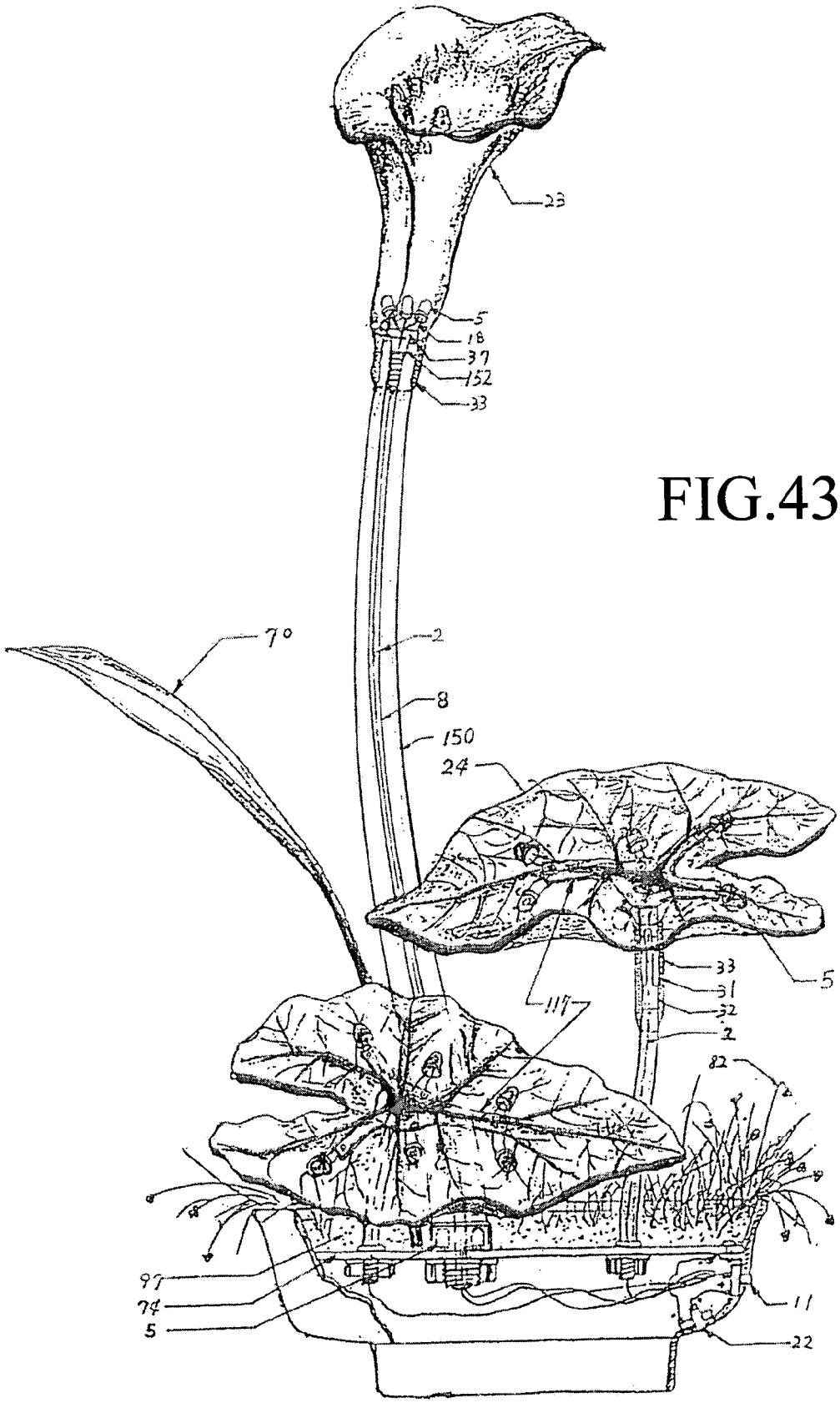
FIG. 43 is a schematic view of a medium size potted calla lily, with LEDS and a soft FPC sealed in the molded transparent resin structures and formed along the rear surface of the flower and the leaf.

Referring to FIGS. 25 and 26, this embodiment is a combination of the former embodiment 3 using the A connector 31 and the A receptacle 32, and embodiment 4 using the B connector 34 and the B receptacle 35, the C1 connector 152 is threadedly engaged, (or may use an externally threaded connector 121) to the upper portion of the trunk. A dwarf cactus 81 may be included using methods previously described. For a tall cactus 113 and artifact 38 (see FIGS. 25, 13), an elongated strip shaped hard or soft circuit board 115 is installed in the molded transparent resin structure. The negative copper foil of the circuit board 115 is welded to a copper alloy clamp 112 which is clamped to a base plate 78 with a threaded nut. For those medium sized flowers 23, leaf blades 24 etc. a flexible irregular circuit board 117 is sealed in the molded structure (see FIGS. 43, 47) and fitted to the receptacles 32, 35 or threadedly engaged to the submain tube end. The LEDS 5 for illuminating the butterfly 16, the dragonfly or the flying bird, may be fixed to the base plate 78 of the medium or small sized PCB using G1, G3, G4 slim alloy copper tubes 4 and copper alloy joints 132. Besides, the root of the trunk 8 supporting the flower 23, such as an Alice orchid 80 or a *cottlea* SP. 79, is inserted into and welded to the through hole of the base plate 78. Hair-like artificial conferous pine leaves or spadix flowers may be formed of optical fibers 40 having one end bound to the molded transparent resin structure 77, as shown in FIGS. 26 and 26A. The molded transparent resin structure 77 comprises a plurality of automatically color variable LEDS 5, the plant trunk of A connector 31, the A receptacle 32 and the B connector 34, the B receptacle 35. The colored light is directed from the molded structure 77 by the optical fiber to its exposed round head.

Embodiment 8

Figure 27:
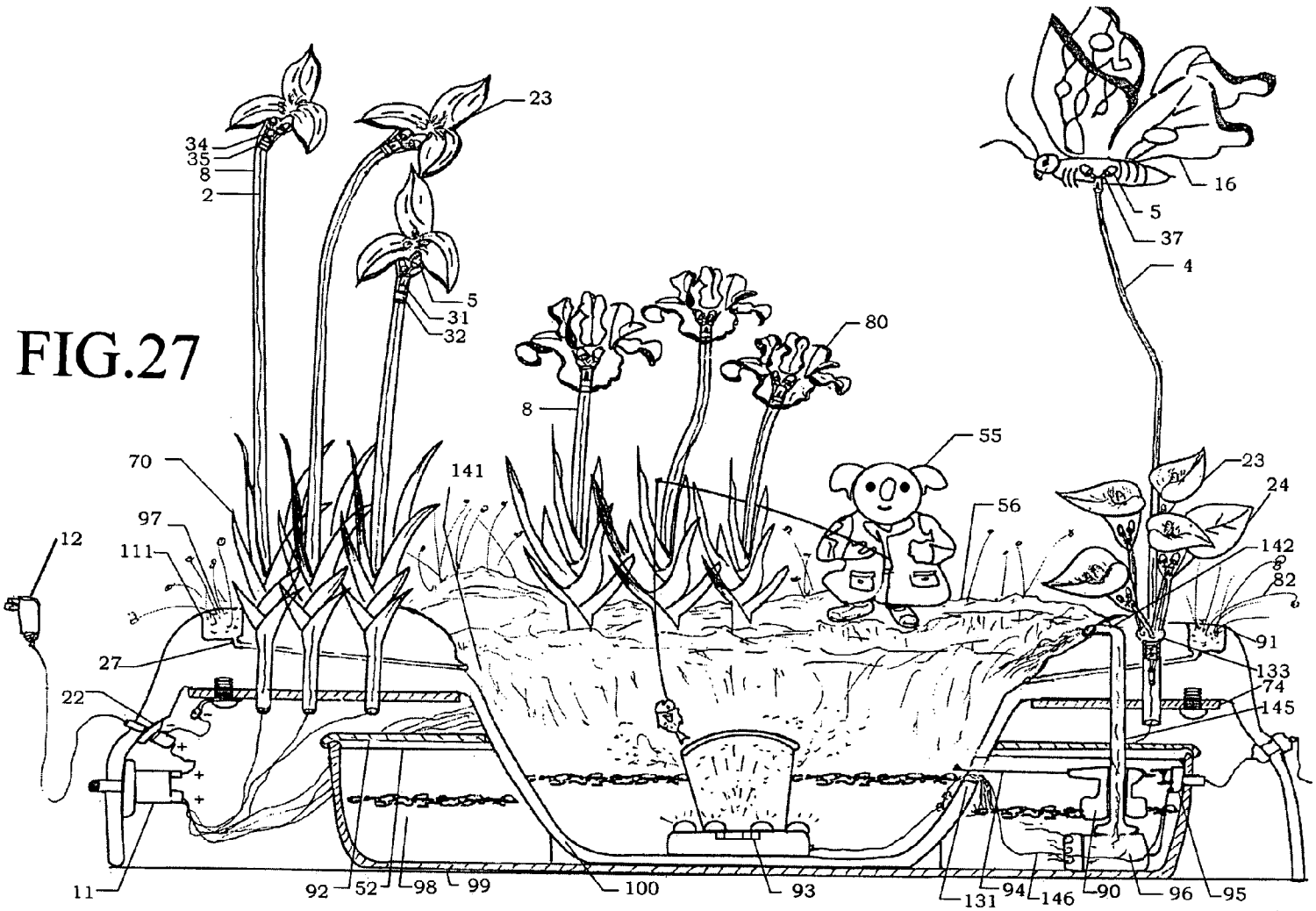
FIG. 27 is a schematic view of a potted plant equipped with a water spray damper and a water circulating system.
Figure 28:
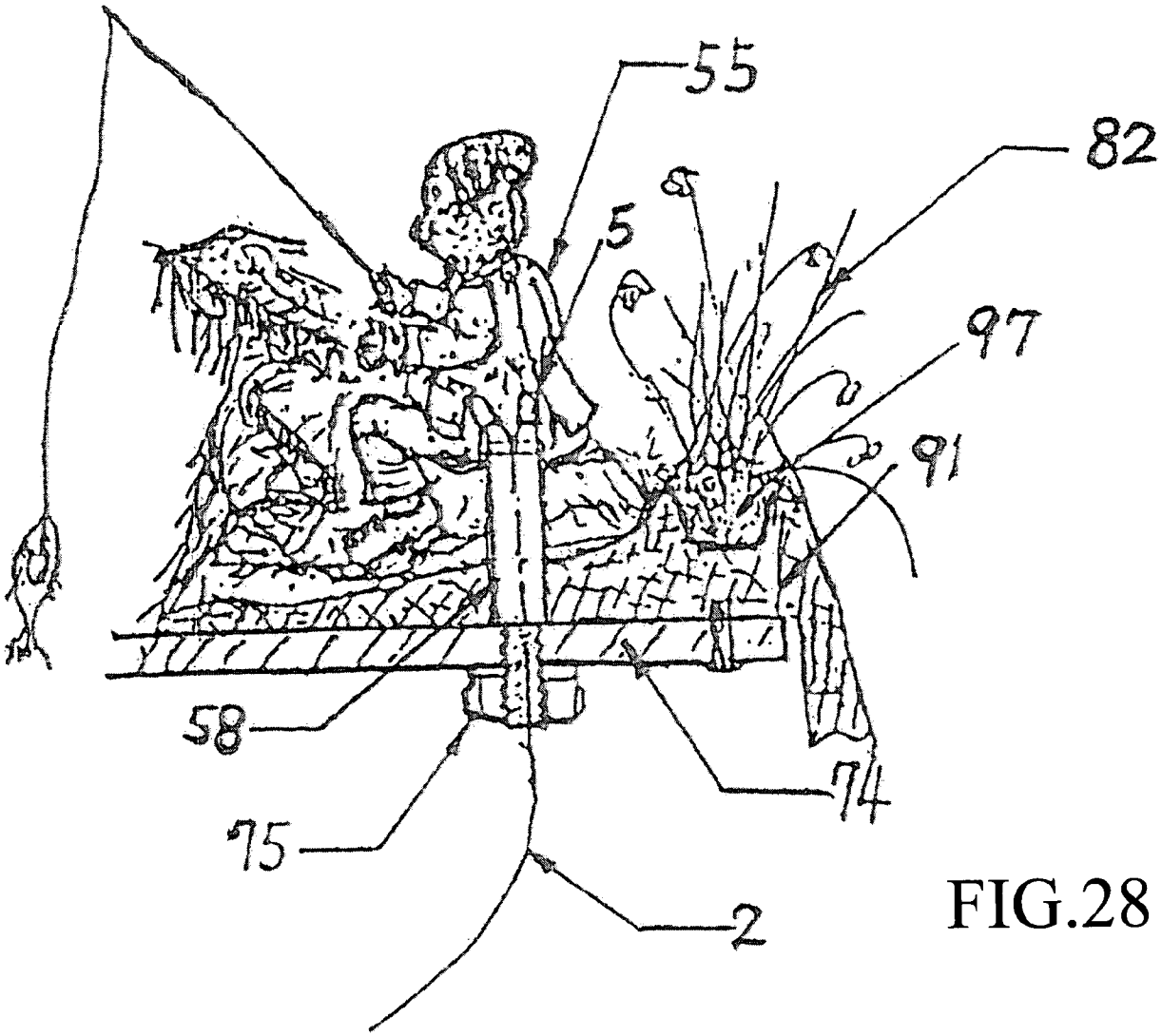
FIG. 28 is an statue of a fishing raccoon illuminated with LEDS.

Referring to FIGS. 27 and 28, the present invention comprises the metallic tubular submain 14, molded transparent resin structure 23, 24, 55, a butterfly 16, electrically insulated conductors 2, a bonsai pot 91, a lid 92, a fog generator 93, a water level detector 94, a microswitch 95, a submersible pump 96, a sponge groove 111, A connector 31, A receptacle 32, B connector 34, B receptacle 35, base connectors 22, and a C1 connector 152. The C1 connector is threadedly engaged, (or may use an externally threaded connector 121) to the upper portion of the trunk, the colored soft plastic bushing 33 is compressed onto the embodiment 3 structure using the A connector 31 and the A receptacle 32 and onto the embodiment 4 structure using the B connector 34 and the B receptacle 35, the trunk 8 supports a decorative foliage 70 at its top, the metallic tubular submain 14 is fixed to a negative metallic base plate 74 with a nut and washer combination 75, the negative metallic base plate 74 is fixed into a bonsai pot 91 with a binder made of mixed resin and a ballast material. This embodiment comprises a bonsai pot 91 molded from a mixture of resin with stone powder and fiber glass. A water basin 99 is placed beneath the bonsai pot 91, the weight of water basin 99 being sustained with its barrier plate 52, which is also capable of positioning the water basin so that it does not move. The water basin 99 also has a lid 92. The bonsai pot 91 includes a colored miniature landscape model 56, a pond 100, and an artifact 55. The pond 100 contains a fog generator 93, refined oil and water 98 therein. The water basin 99 contains a water level detector 94, a submergible pump 96, water, a float 90, and a microswitch 95. If the water level of the pond 100 is too high, the excessive water over flows out through an overflow port 131 and returns to the water basin 99. The scenic display of a water scene and recycling water flow on the bonsai pot 91 is served by actuating the fog generator 93 and the pump 96 with the control of the microswitch 95. When the water level of the pond 100 is too low, the microswitch 95 will trip to interrupt the power supply in accordance with the descending of the float 90 caused by the lowering of the water and refined oil 98 level.

A plurality of slim vines are inserted on a sponge 97 of sponge groove 111 to serve as a hanging ornament 82. The metallic tubular submains 14 are fixed in the lower chamber 26 to one positive terminal of the power supply switch 11, the other terminal switch is connected to the positive terminal of the base connector 22.

Embodiment 9

Figure 38:
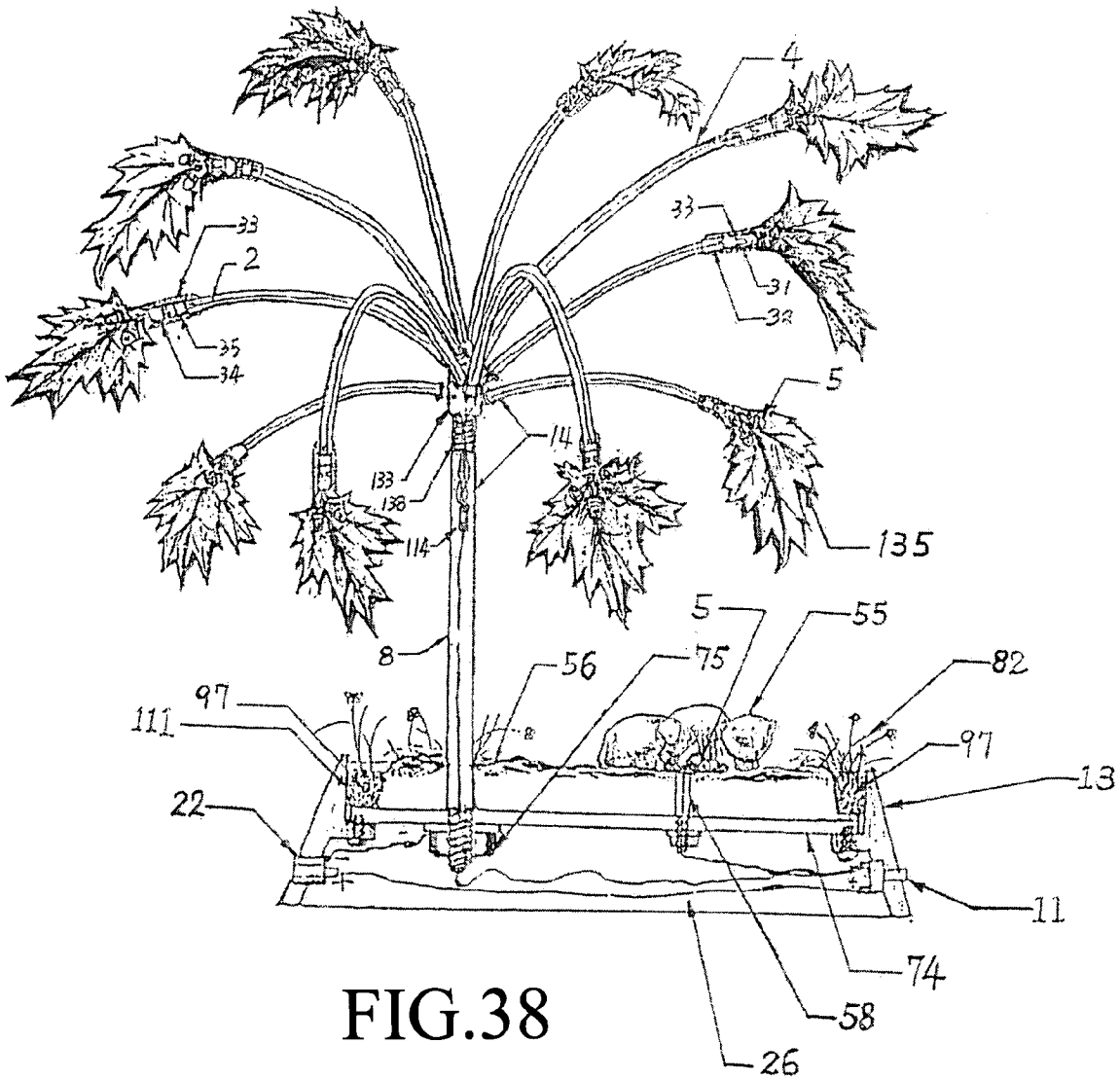
FIG. 38 is a miniature model landscape wherein a bear statue is resting under the maple tree.
Figure 40:
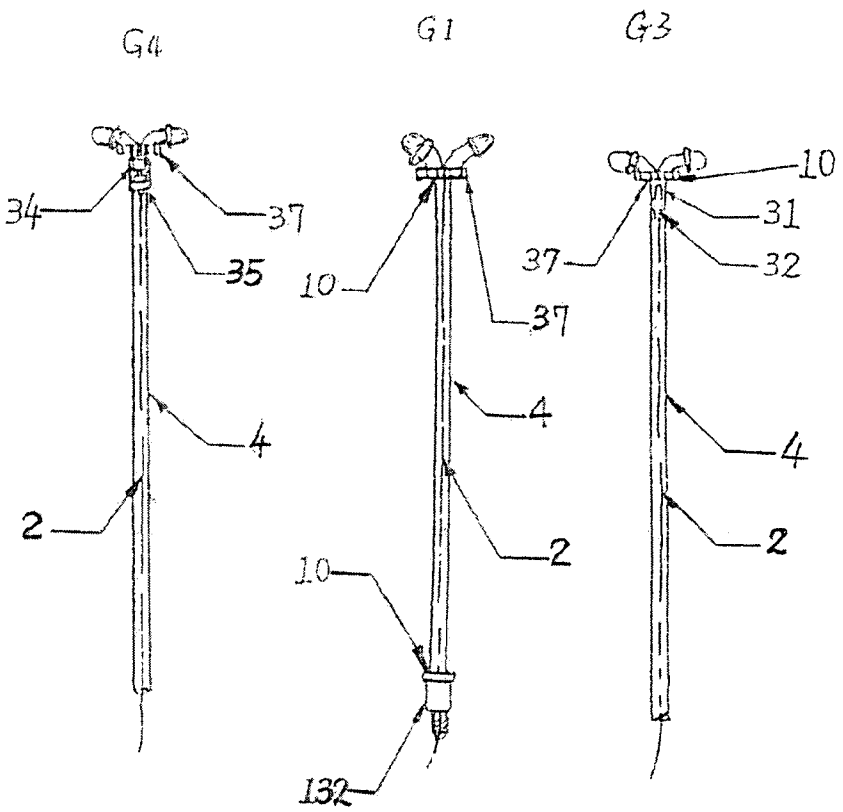
FIG. 40 is a schematic view in which several forms of connecting LEDS to a slim copper alloy tube are shown.
Figure 39:
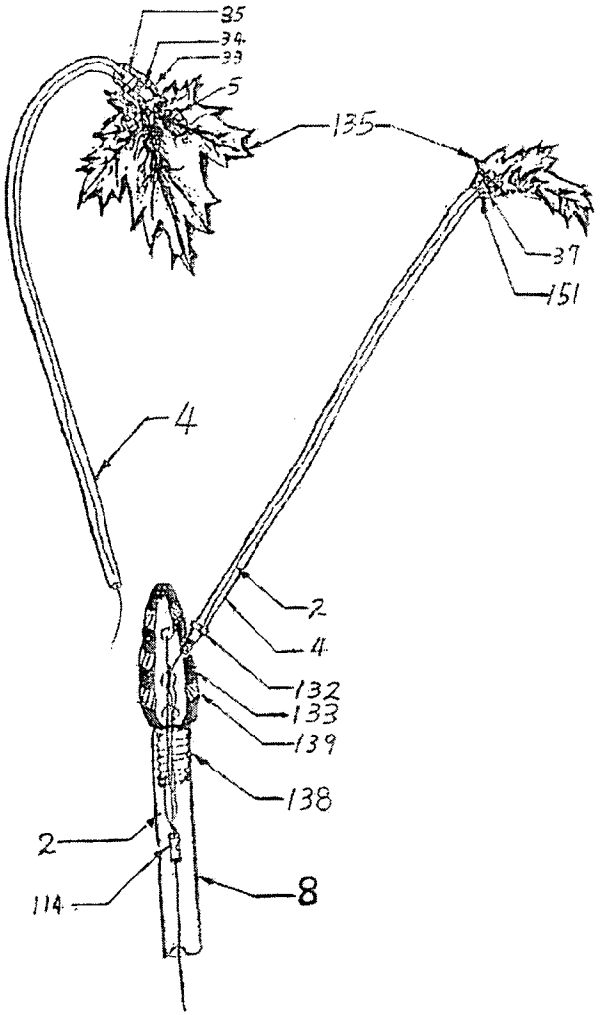
FIG. 39 is a schematic view showing several metallic conductor branches connected to one main conductor tube.
Figure 41:
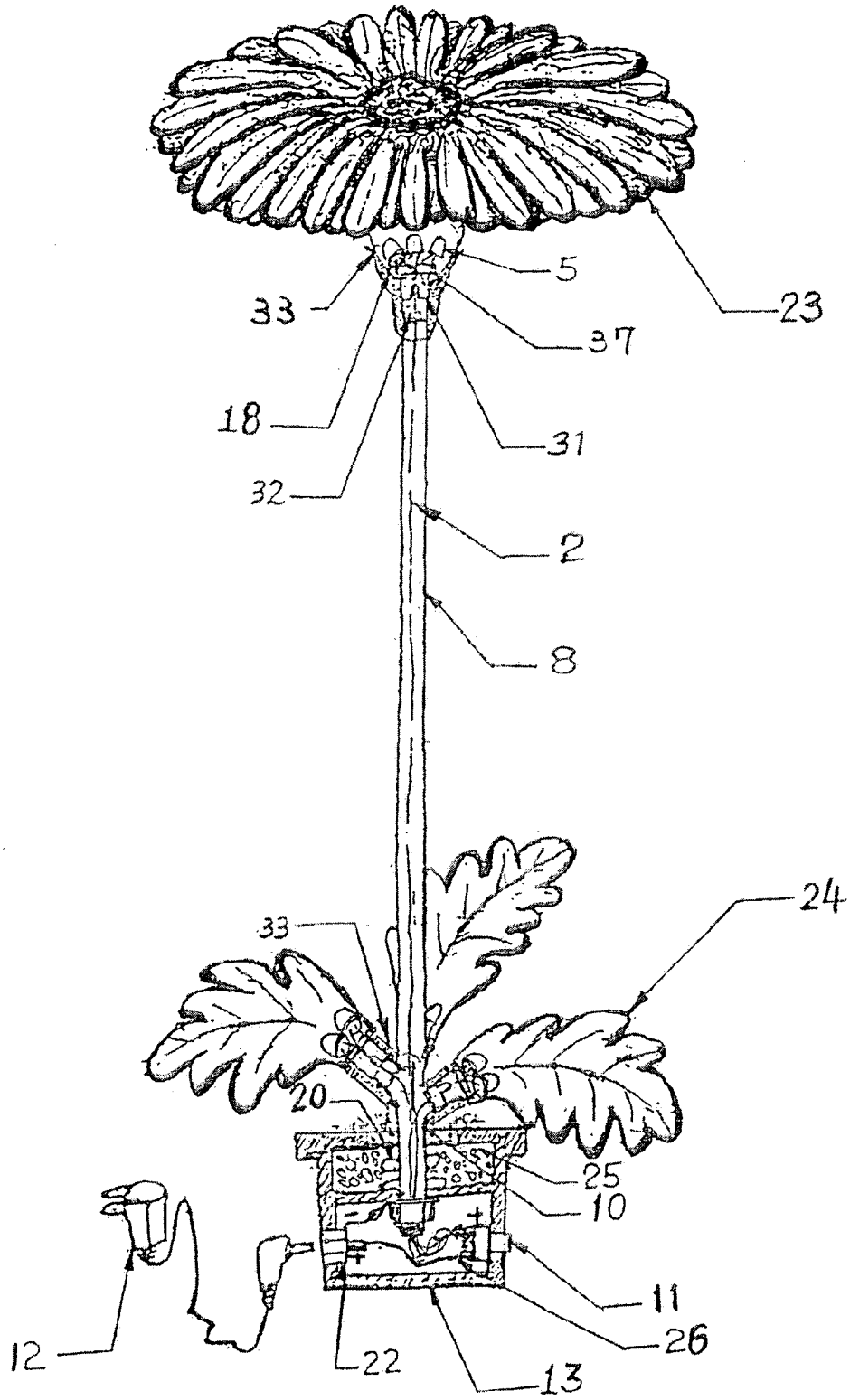
FIG. 41 is a schematic view of an LED illuminated potted African daisy (sunflower) assembled with A connectors.
Figure 42:
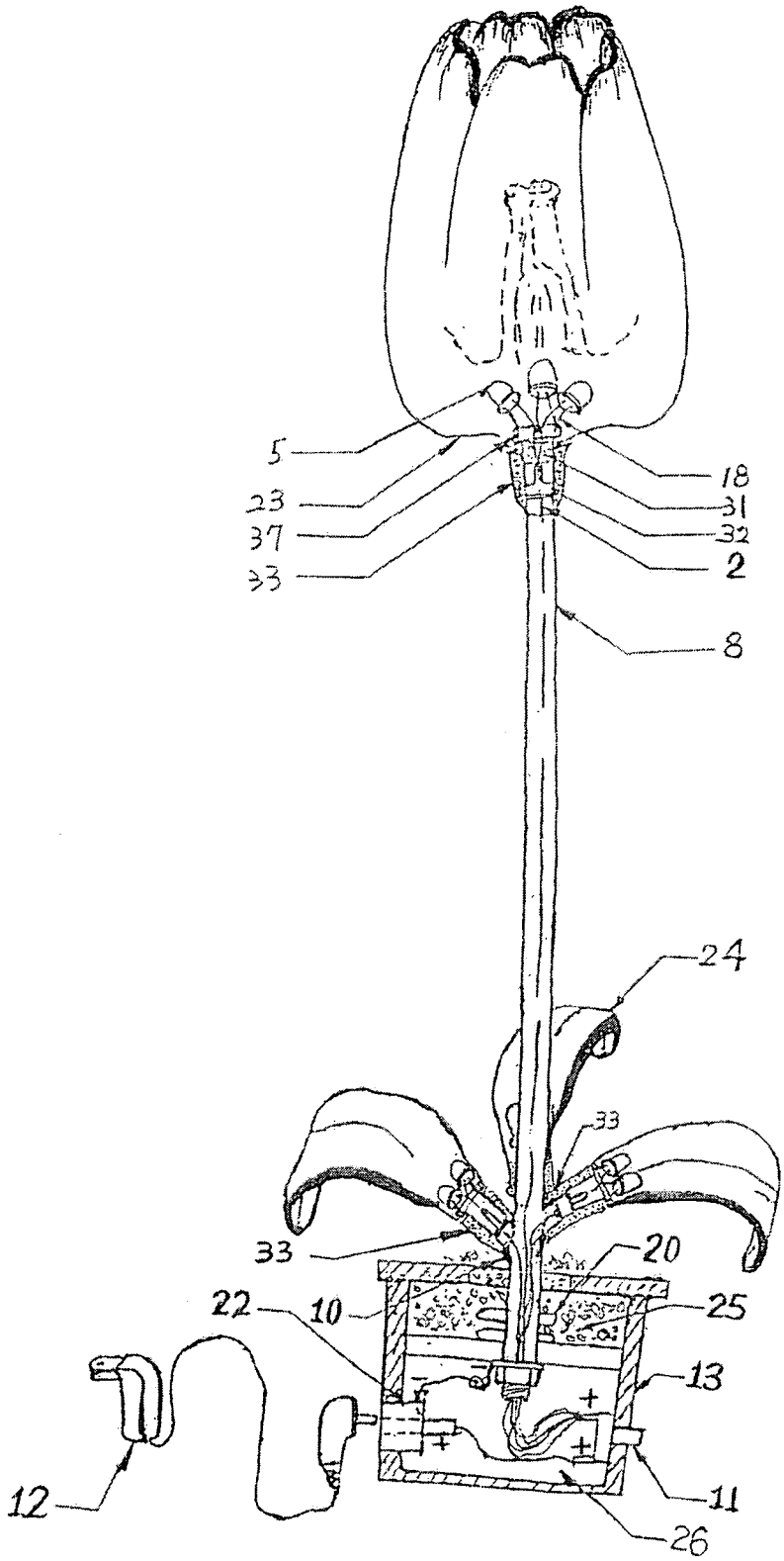
FIG. 42 is a schematic view of an LED illuminated potted tulip assembled with A connectors.

Referring to FIG. 38, the present invention comprises the metallic tubular submain 14, molded transparent resin structures 23, 24, and 55, electrically insulated conductors 2, A connector 31, A receptacle 32, B connector 34, B receptacle 35, base connectors 22, miniature landscape model 56, negative metallic base plate 74, sponge groove 111, copper alloy joints 132, and main tube connector 133. The metallic tubular submain 14 includes a plurality of flexible and various sized metallic copper conductor tubes, copper alloy tubes, or metal plated (silver or tin) tubes welded together. In this embodiment, the tip of the trunk 8 is joined with a main tube connector 133 by welding or threaded connection 138. Several threaded holes 139 provided on the top of the main tube connector 133 are welded to, or threadedly engaged by several copper alloy tubes 4 which are covered with the molded transparent resin structure of the flower leaf, flying bird, or dragonfly (see FIG. 39). A cone shaped or a funnel shaped molded transparent resin structure 151 may be formed beneath the rear of the leaf blade so as to accommodated the LEDS 5 and a PCB. A PCB 37 using the A connector 31 and the A receptacle 32 or the structure of embodiment 4 using the B connector 34 and the B receptacle 35 is provided. The LEDS 5, which are connected in parallel, are formed on a copper foil at the upper/lower surface of the PCB 37, and one end of the copper alloy tube 4 is welded to the center portion of the negative copper foil provided beneath the PCB (see FIG. 40G1). The artifact 55, such as an artificial molded transparent resin structure of a bear statue is inlaid in the miniature landscape model 56 (see FIG. 38), For decoration of the miniature landscape 56 and pots 13, instead of a sponge groove 111, a plurality of slim vines are inserted on a sponge 97 so as to serve as a hanging ornament 82.

The metallic tubular submains 14 are fixed on the lower chamber 26 to one positive terminal of the power supply switch 11, the other terminal of the switch is connected to the positive terminal of the base connector 22.

Many changes and modification in the above described embodiments of the invention can, of course, be carried out with out departing from the scope thereof. Accordingly, to promote the progress in science and the useful arts, the invention is disclosed and is intended to be limited only by the scope of the appended claims.

The invention claimed is:

1. An artificial miniature landscape model with three dimensionally colored lighting, comprising:

a pot having a base plate disposed therein;

a switch mounted to said pot, said switch having one terminal coupled to a first lead of a source of power; and at least one artificial plant structure coupled to said base plate, said artificial plant structure including:

(a) a metallic tubular assembly simulative of at least one of a trunk, branches and a stem of the artificial plant structure coupled to said base plate, said metallic tubular assembly being coupled to a second lead of the source of power and having an axially directed through bore;

(b) an electrical conductor disposed in said through bore of said metallic tubular assembly and having a first end connected to a second terminal of said switch; and, (c) a three dimensional structure simulative of at least one of a flower, leaf or branch structure formed of a molded light transmissive resin and releasably coupled to said metallic tubular assembly, said three dimensional structure including at least one multicolor light emitting element encapsulated by said resin and a control circuit encapsulated by said resin and electrically coupled to said at least one multicolor light emitting element and a second end of said electrical conductor.

2. An artificial miniature landscape model with three dimensionally colored lighting, comprising:

a pot having a base plate disposed therein;

a switch mounted to said pot, said switch having one terminal coupled to a first lead of a source of power; and at least one artificial plant structure coupled to said base plate, said artificial plant structure including:

(a) a metallic tubular assembly simulative of at least one of a trunk, branches and a stem of the artificial plant structure coupled to said base plate, said metallic tubular assembly being coupled to a second lead of the source of power and having an axially directed through bore;

(b) at least one first electrical connector coupled to said metallic tubular assembly;

(c) an electrical conductor disposed in said through bore of said metallic tubular assembly and having one end connected to a second terminal of said switch and an opposing end coupled to said first electrical connector; and, (d) a three dimensional structure simulative of at least one of a flower, leaf or branch structure formed of a molded light transmissive resin, said three dimensional structure including a second electrical connector for matingly coupling to said first electrical connector, said coupling of said first and second electrical connectors providing both an electrical connection and mechanical support of said three dimensional structure to said metallic tubular assembly, said three dimensional structure including at least one multicolor light emitting element encapsulated by said resin and electrically coupled to said second electrical connector.

3. The artificial miniature landscape model as recited in claim 2, wherein said three dimensional structure further includes a control circuit encapsulated by said resin and electrically coupled to said at least one multicolor light emitting element and said second electrical connector.

4. The artificial miniature landscape model as recited in claim 2, wherein said three dimensional structure further includes a plurality of multicolor light emitting elements encapsulated by said resin and electrically coupled in parallel relationship.

5. The artificial miniature landscape model as recited in claim 4, wherein said light transmissive resin diffuses light from said plurality of multicolor light emitting elements.

6. The artificial miniature landscape model as recited in claim 2, wherein said metallic tubular assembly has a portion thereof within said pot having a pair of flanges extending therefrom for fixation in said pot with a resin binder composition.

7. The artificial miniature landscape model as recited in claim 2, wherein said light transmissive resin diffuses light from said multicolor light emitting element.

8. The artificial miniature landscape model as recited in claim 2, wherein said metallic tubular assembly includes a plurality of hollow copper tubes joined together.

9. The artificial miniature landscape model as recited in claim 2, further comprising:

a simulated pond disposed at an upper portion of said pot;

a liquid reservoir disposed in a lower portion of said pot, said simulated pond having an overflow port coupled in fluid communication with said liquid reservoir for retuning liquid from said simulated pond to said liquid reservoir;

a submersible pump disposed in said liquid reservoir and coupled in fluid communication with said simulated pond for delivering a liquid thereto; and a liquid level sensor disposed in said simulated pond and electrically coupled to said submersible pump for control thereof responsive to a liquid level in said simulated pond.

10. The artificial miniature landscape model as recited in claim 2, further comprising an artifact formed of said light transmissive resin and disposed at an upper portion of said pot, said artifact including at least one second multicolor light emitting element electrically coupled to said second terminal of said switch and said second lead of the source of power.

* * * * *